US008138999B2

(12) United States Patent
Yamamoto et al.

(10) Patent No.: US 8,138,999 B2
(45) Date of Patent: Mar. 20, 2012

(54) DISPLAY DEVICE AND ELECTRONIC APPARATUS

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 630 days.

(21) Appl. No.: 12/314,647

(22) Filed: Dec. 15, 2008

(65) Prior Publication Data

US 2009/0167647 A1 Jul. 2, 2009

(30) Foreign Application Priority Data

Dec. 26, 2007 (JP) ..... P2007-333722

(51) Int. Cl.
*G09G 3/30* (2006.01)

(52) U.S. Cl. ..... 345/76; 345/77; 315/169.3

(58) Field of Classification Search ..... 345/76–83, 345/36, 39; 315/169.3
See application file for complete search history.

(56) References Cited

U.S. PATENT DOCUMENTS

2007/0115224 A1* 5/2007 Yamamoto et al. ..... 345/76
2007/0115225 A1* 5/2007 Uchino et al. ..... 345/76
2007/0132694 A1* 6/2007 Uchino et al. ..... 345/92
2007/0164962 A1* 7/2007 Uchino et al. ..... 345/92
2007/0247399 A1* 10/2007 Yamashita et al. ..... 345/82
2007/0273620 A1* 11/2007 Yumoto ..... 345/76
2008/0030436 A1* 2/2008 Iida et al. ..... 345/77

FOREIGN PATENT DOCUMENTS

JP 2003-255856 A 9/2003
JP 2003-271095 A 9/2003
JP 2004-029791 A 1/2004
JP 2004-093682 A 3/2004
JP 2004-133240 A 4/2004

* cited by examiner

*Primary Examiner* — Amare Mengistu
*Assistant Examiner* — Hong Zhou
(74) *Attorney, Agent, or Firm* — Rader, Fishman & Grauer PLLC

(57) ABSTRACT

Disclosed herein is a display device including a pixel array part configured to include scan lines disposed along rows, signal lines disposed along columns, and pixels that are disposed at intersections of the scan lines and the signal lines and arranged in a matrix, each of the pixels having at least a sampling transistor, a drive transistor, a switching transistor, a hold capacitor, and a light-emitting element; and a drive part configured to include a scanner and a driver, the driver supplying a video signal to the signal lines along the columns.

5 Claims, 20 Drawing Sheets

DISPLAY DEVICE AND ELECTRONIC APPARATUS

CROSS REFERENCES TO RELATED APPLICATIONS

The present invention contains subject matter related to Japanese Patent Application JP 2007-333722 filed in the Japan Patent Office on Dec. 26, 2007, the entire contents of which being incorporated herein by reference.

BACKGROUND OF THE INVENTION

1. Field of the Invention

The present invention relates to an active-matrix display device including light-emitting elements in its pixels. Furthermore, the present invention relates to electronic apparatus including such a display device.

2. Description of the Related Art

In recent years, development of flat self-luminous display devices employing organic EL devices as light-emitting elements is being actively promoted. The organic EL device is based on a phenomenon that an organic thin film emits light in response to application of an electric field thereto. The organic EL (Electro Luminescence) device can be driven by application voltage of 10 V or lower, and thus has low power consumption. Furthermore, because the organic EL device is a self-luminous element that emits light by itself, it does not need an illuminating unit and thus easily allows reduction in the weight and thickness of a display device. Moreover, the response speed of the organic EL device is as very high as about several microseconds, which causes no image lag in displaying of a moving image.

Among the flat self-luminous display devices employing the organic EL devices for the pixels, particularly an active-matrix display device in which thin film transistors are integrally formed as drive elements in the respective pixels is being actively developed. Active-matrix flat self-luminous display devices are disclosed in e.g. Japanese Patent Laid-Open No. 2003-255856, 2003-271095, 2004-133240, 2004-029791, and 2004-093682.

FIG. 15 is a schematic circuit diagram showing one example of an active-matrix display device of a related art. The display device includes a pixel array part 1 and a peripheral drive part. The drive part includes a signal driver 3 and a write scanner 4. The pixel array part 1 includes signal lines SL disposed along the columns and scan lines WS disposed along the rows. Pixels 2 are disposed at the respective intersections of the signal lines SL and the scan lines WS. FIG. 15 shows merely one pixel 2 for easy understanding. The write scanner 4 includes shift registers. The shift registers operate in response to a clock signal ck supplied from the external and sequentially transfer a start pulse sp supplied from the external similarly, to thereby output a control signal to the scan lines WS sequentially. The signal driver 3 supplies a video signal to the signal lines SL in matching with the line-sequential scanning by the write scanner 4.

The pixel 2 includes a sampling transistor T1, a drive transistor T2, a hold capacitor C1, and a light-emitting element EL. The drive transistor T2 is a P-channel transistor. The source thereof is connected to a power supply line and the drain thereof is connected to the light-emitting element EL. The gate of the drive transistor T2 is connected to the signal line SL via the sampling transistor T1. The sampling transistor T1 is turned on in response to the control signal supplied from the write scanner 4 to thereby sample the video signal supplied from the signal line SL and write it to the hold capacitor C1. The drive transistor T2 receives, at its gate, the video signal written to the hold capacitor C1 as a gate voltage Vgs, and causes a drain current Ids to flow to the light-emitting element EL. This causes the light-emitting element EL to emit light with the luminance dependent upon the video signal. The gate voltage Vgs refers to the potential of the gate relative to that of the source.

The drive transistor T2 operates in the saturation region, and the relationship between the gate voltage Vgs and the drain current Ids is represented by the following characteristic equation.

$$Ids=(1/2)\mu(W/L)Cox(Vgs-Vth)^2$$

In this equation, μ denotes the mobility of the drive transistor, W denotes the channel width of the drive transistor, L denotes the channel length of the drive transistor, Cox denotes the gate insulation capacitance of the drive transistor, and Vth denotes the threshold voltage of the drive transistor. As is apparent from this characteristic equation, the drive transistor T2 functions as a constant current source that supplies the drain current Ids depending on the gate voltage Vgs when it operates in the saturation region.

FIG. 16 is a graph showing the voltage-current characteristic of the light-emitting element EL. In this graph, an anode voltage V is plotted on the abscissa and the drive current Ids is plotted on the ordinate. The anode voltage of the light-emitting element EL is equivalent to the drain voltage of the drive transistor T2. The light-emitting element EL has a tendency that its current-voltage characteristic changes over time and the characteristic curve gradually falls down along with time elapse. Therefore, the anode voltage (drain voltage) V changes even if the drive current Ids is constant. However, in the pixel circuit 2 shown in FIG. 15, the drive transistor T2 operates in the saturation region and allows the flowing of the drive current Ids dependent upon the gate voltage Vgs irrespective of change in the drain voltage. This makes it possible to keep the light-emission luminance constant irrespective of aging change in the characteristic of the light-emitting element EL.

FIG. 17 is a circuit diagram showing another example of a related-art pixel circuit. This pixel circuit is different from the pixel circuit shown in FIG. 15 in that the drive transistor T2 is not a P-channel transistor but an N-channel transistor. In many cases, it is more advantageous that all of the transistors included in the pixel are N-channel transistors in terms of the circuit manufacturing process.

However, in the circuit configuration of FIG. 17, because the drive transistor T2 is an N-channel transistor, the drain thereof is connected to the power supply line and a source S thereof is connected to the anode of the light-emitting element EL. Therefore, if the characteristic of the light-emitting element EL changes over time, the potential of the source S is affected and thus Vgs changes, which leads to aging change in the drain current Ids supplied from the drive transistor T2. This results in a problem that the luminance of the light-emitting element EL changes over time.

Furthermore, the threshold voltage Vth and the mobility μ of the drive transistor T2 also vary from pixel to pixel. Because these parameters μ and Vth are included in the above-mentioned transistor characteristic equation, Ids changes even if Vgs is constant. This leads to variation in the light-emission luminance from pixel to pixel, which is a problem that should be solved.

To address such a problem, there has been proposed a related-art display device in which functions for correction against variations in the threshold voltage Vth and the mobility μ of the drive transistor are incorporated in each pixel.

However, the pixel with such correction functions has a complex circuit configuration, and a switching transistor is desired in addition to the drive transistor and the sampling transistor. In addition, the drive part also needs to further include an additional scanner for line-sequential scanning of the switching transistors besides the write scanner for line-sequential scanning of the sampling transistors.

However, the addition of the scanner to the drive part leads to a problem of causing increase in the product cost. Furthermore, a structure in which the peripheral drive part is formed integrally with the pixel array part on the same panel involves a problem that the addition of the scanner causes the lowering of the panel yield. Moreover, the addition of the scanner inevitably causes increase in the layout area of the peripheral drive part. The peripheral drive part is so arranged on the panel as to surround the center pixel array part in a frame manner. The increase in the layout area of the peripheral drive part inevitably causes enlargement of the frame part of the panel and thus leads to the lowering of the yield, which is a problem that should be solved.

SUMMARY OF THE INVENTION

There is a need for the embodiment of the present invention to provide a display device including a reduced number of scanners in a drive part. According to a mode of the present invention, there is provided a display device including a pixel array part configured to include scan lines disposed along rows, signal lines disposed along columns, and pixels that are disposed at the intersections of the scan lines and the signal lines and arranged in a matrix. Each of the pixels has at least a sampling transistor, a drive transistor, a switching transistor, a hold capacitor, and a light-emitting element. The display device further includes a drive part configured to include a scanner and a driver. The driver supplies a video signal to the signal lines along the columns. In this display device, the control terminal of the sampling transistor is connected to the scan line, and a pair of current terminals of the sampling transistor are connected between the signal line and the control terminal of the drive transistor. The current terminal of the drive transistor on the drain side is connected to a power supply, and the current terminal of the drive transistor on the source side is connected to the light-emitting element. The hold capacitor is connected between the control terminal of the drive transistor as the gate of the drive transistor and the current terminal of the drive transistor on the source side. One of a pair of current terminals of the switching transistor is connected to the current terminal of the drive transistor on the source side and the other of the pair of current terminals of the switching transistor is coupled to a fixed potential. The control terminal of the switching transistor is connected to the scan line disposed on a row previous to the row of the scan line connected to the control terminal of the sampling transistor. The scanner drives the sampling transistor and the switching transistor included in the pixel by sequentially supplying a control signal to the scan lines along the rows, to thereby supply a drive current dependent upon a video signal from the drive transistor to the light-emitting element.

According to the mode of the present invention, the control terminal (gate) of the switching transistor is connected to the scan line disposed on a row previous to that of the scan line connected to the control terminal (gate) of the sampling transistor. Corresponding to this configuration, the scanner of the drive part line-sequentially drives the sampling transistors and the switching transistors included in the respective pixels by sequentially supplying the control signal to the scan lines along the rows. In other words, the sampling transistors and the switching transistors included in the respective pixels are line-sequentially driven by one scanner. By thus reducing the number of scanners included in the drive part to the minimum value, the manufacturing cost is reduced. Furthermore, for a structure in which the peripheral drive part is formed integrally with the pixel array part on the same panel, reduction in the frame size of the panel can be achieved and thus the yield can be enhanced because the layout area of the drive part can be decreased.

DETAILED DESCRIPTION OF THE PREFERRED EMBODIMENT

Figure 1:
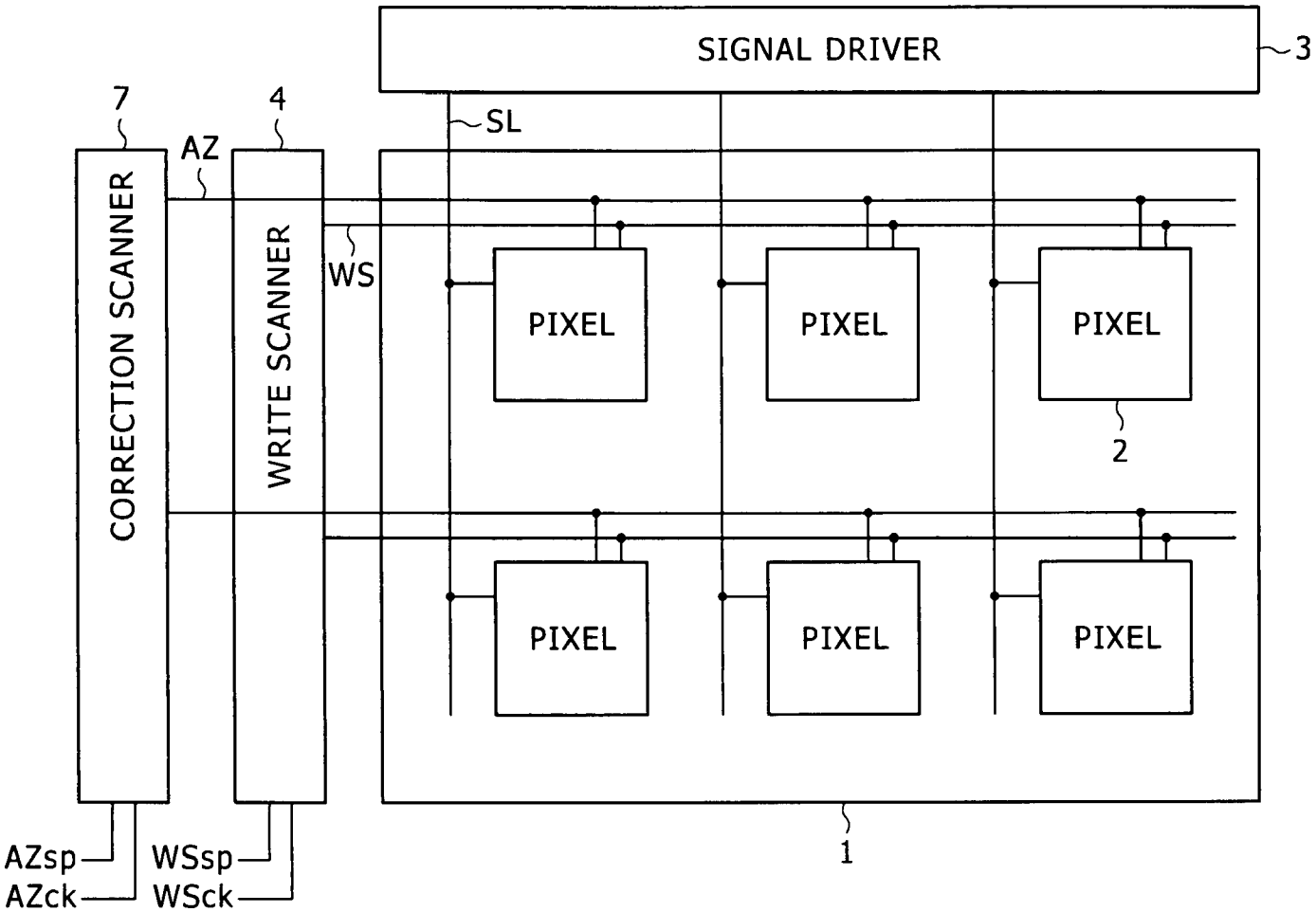
FIG. 1 is a block diagram showing the entire configuration of a display device according to a reference example.

An embodiment of the present invention will be described in detail below with reference to the drawings. FIG. 1 is a block diagram showing the entire configuration of a display device. This display device is a reference example according to a previously-developed technique as the basis of the embodiment of the present invention. In order to clearly show the background of the present invention and facilitate understanding thereof, this previously-developed technique example will be described below as a part of the embodiment of the present invention. As shown in FIG. 1, this display device is basically composed of a pixel array part 1 and a drive part for driving the pixel array part 1. The pixel array part 1 includes scan lines WS disposed along the rows, scan lines AZ disposed along the rows, signal lines SL disposed along the columns, and pixels 2 that are disposed at the respective intersections of the scan lines WS and the signal lines SL so as to be arranged in a matrix. The drive part includes a write scanner 4, a correction scanner 7, and a signal driver 3. The write scanner 4 outputs a control signal to the respective scan lines WS to thereby line-sequentially scan the pixels 2 on a row-by-row basis. The correction scanner 7 also outputs a control signal to the respective scan lines AZ to thereby line-sequentially scan the pixels 2 on a row-by-row basis. The write scanner 4 and the correction scanner 7 are different from each other in the timing of the outputting of the control signal. The signal driver 3 supplies a signal potential and a reference potential of a video signal to the signal lines SL along the columns in matching with the line-sequential scanning by the scanners 4 and 7. The write scanner 4 includes shift registers. The shift registers operate in response to a clock signal WSck supplied from the external and sequentially transfer a start pulse WSsp supplied from the external similarly, to thereby output the predetermined control signal to the respective scan lines WS. The output timing of the control signal is regulated by the clock signal WSck, and the waveform of the control signal is defined by the start pulse WSsp. The correction scanner 7 also includes shift registers similarly. The shift registers operate in response to a clock signal AZck supplied from the external and sequentially transfer a start pulse AZsp supplied from the external similarly, to thereby output the control signal having a predetermined waveform to the respective scan lines AZ. The clock signals WSck and AZck have the same cycle, and the scanners 4 and 7 operate at the same line-sequential scanning timing.

Figure 2:
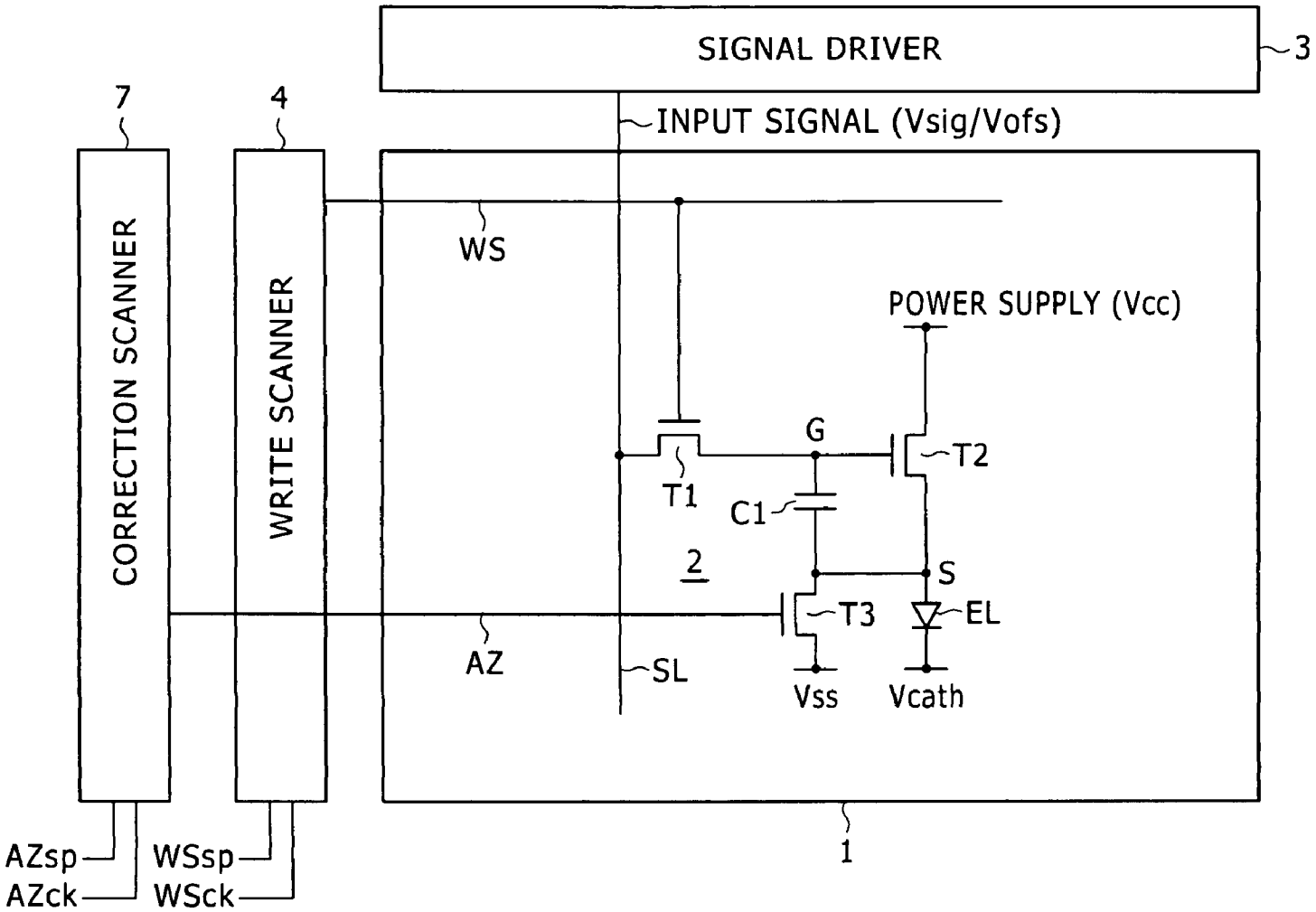
FIG. 2 is a circuit diagram showing the pixel configuration of the display device shown in FIG. 1.

FIG. 2 is a circuit diagram showing the configuration of the pixel 2 in the display device shown in FIG. 1. As shown in FIG. 2, this pixel 2 basically includes a light-emitting element EL, a sampling transistor T1, a drive transistor T2, a switching transistor T3, and a hold capacitor C1. The control terminal (gate) of the sampling transistor T1 is connected to the scan line WS. One of a pair of current terminals (source and drain) of the sampling transistor T1 is connected to the signal line SL, and the other is connected to the control terminal (gate G) of the drive transistor T2. One (drain) of a pair of current terminals (source and drain) of the drive transistor T2 is connected to a power supply line Vcc, and the other (source S) is connected to the anode of the light-emitting element EL. The cathode of the light-emitting element EL is coupled to a predetermined cathode potential Vcath. The control terminal (gate) of the switching transistor T3 is connected to the scan line AZ. One of a pair of current terminals (source and drain) of the switching transistor T3 is coupled to a fixed potential Vss, and the other is connected to the source S of the drive transistor T2. One terminal of the hold capacitor C1 is connected to the control terminal (gate G) of the drive transistor T2, and the other terminal thereof is connected to the other current terminal (source S) of the drive transistor T2. Therefore, the hold capacitor C1 is coupled to the fixed potential Vss via the switching transistor T3.

In this configuration, the write scanner 4 in the drive part supplies the control signal for controlling the opening/closing of the sampling transistor T1 to the scan line WS. The correction scanner 7 outputs the control signal for controlling the opening/closing of the switching transistor T3 to the scan line AZ. The signal driver 3 supplies, to the signal line SL, the video signal (input signal) whose potential is switched between a signal potential Vsig and a reference potential Vofs. In this manner, the potentials of the scan lines WS and AZ and the signal line SL change in matching with the line-sequential scanning, whereas the power supply line is fixed at Vcc. The cathode potential Vcath and the fixed potential Vss are also constant.

The summary of the operation of the pixel 2 is as follows. The sampling transistor T1 is turned on in response to the control signal supplied from the first scan line WS, to thereby sample the signal potential Vsig of the video signal supplied from the signal line SL and hold it in the hold capacitor C1. The drive transistor T2 receives current supply from the power supply line Vcc and causes a drive current to flow to the light-emitting element EL depending on the signal potential Vsig written to the hold capacitor C1 so as to start the light-emission state. The switching transistor T3 is turned on in response to the control signal supplied from the second scan line AZ before the sampling of the video signal, to thereby couple the output current terminal (source S) of the drive transistor T2 to the fixed potential Vss so as to cause the light-emitting element EL to enter the non-light-emission state. In the present example, this light-emitting element EL has the anode and the cathode. The anode is connected to the output current terminal (source S) of the drive transistor T2, and the cathode is coupled to the predetermined cathode potential Vcath. The fixed potential Vss, to which one current terminal of the switching transistor T3 is coupled, is set lower than the cathode potential Vcath.

In this display device, the switching transistor T3 is disposed in each pixel circuit 2, which allows provision of a non-light-emission period before a sampling period. The provision of the non-light-emission period allows threshold voltage correction operation and mobility correction operation for the drive transistor T2.

In order to carry out the threshold voltage correction operation for each pixel 2 in the non-light-emission period, the signal driver 3, the write scanner 4, and the correction scanner 7 included in the drive part serve as a threshold voltage corrector as a part of the functions thereof. This threshold voltage corrector carries out correction operation of writing the voltage equivalent to the threshold voltage Vth of the drive transistor T2 included in the pixel 2 to the hold capacitor C1 through control of the first scan line WS, the second scan line AZ, and the signal line SL, to thereby cancel variation in the threshold voltage among the pixels. Depending on the case, this threshold voltage corrector can repeatedly carry out the correction operation separately in plural horizontal periods previous to the sampling of the video signal. This threshold voltage corrector sets the potential of the signal line SL to the reference potential Vofs and turns on the sampling transistor T1 to thereby set the potential of the control terminal (gate G) of the drive transistor T2 to the reference potential Vofs. In addition, the threshold voltage corrector turns on the switching transistor T3 to thereby set the potential of the output current terminal (source S) of the drive transistor T2 to the fixed potential Vss lower than the potential obtained by subtracting the threshold voltage Vth from the reference potential Vofs, and then turns off the switching transistor T3. Thereafter, the threshold voltage corrector writes the voltage equivalent to the threshold voltage Vth of the drive transistor T2 to the hold capacitor C1.

The control scanner (write scanner) 4 carries out the mobility correction operation for the pixels 2 in the non-light-emission period. Specifically, the write scanner 4 outputs the control signal having a predetermined time width to the first scan line WS so that the sampling transistor T1 may be turned to the conductive state in the time zone during which the signal line SL is at the signal potential Vsig, thereby, the signal potential is held in the hold capacitor C1, and simultaneously correction relating to the mobility μ of the drive transistor T2 is added to the signal potential. Furthermore, the control scanner (write scanner) 4 turns the sampling transistor T1 to the non-conductive state at the timing when the signal potential has been held in the hold capacitor C1. This allows bootstrap operation in which the potential change of the control terminal (gate G) of the drive transistor follows the potential change of the output current terminal (source S) thereof and thus the voltage Vgs therebetween is kept constant.

Figure 3:
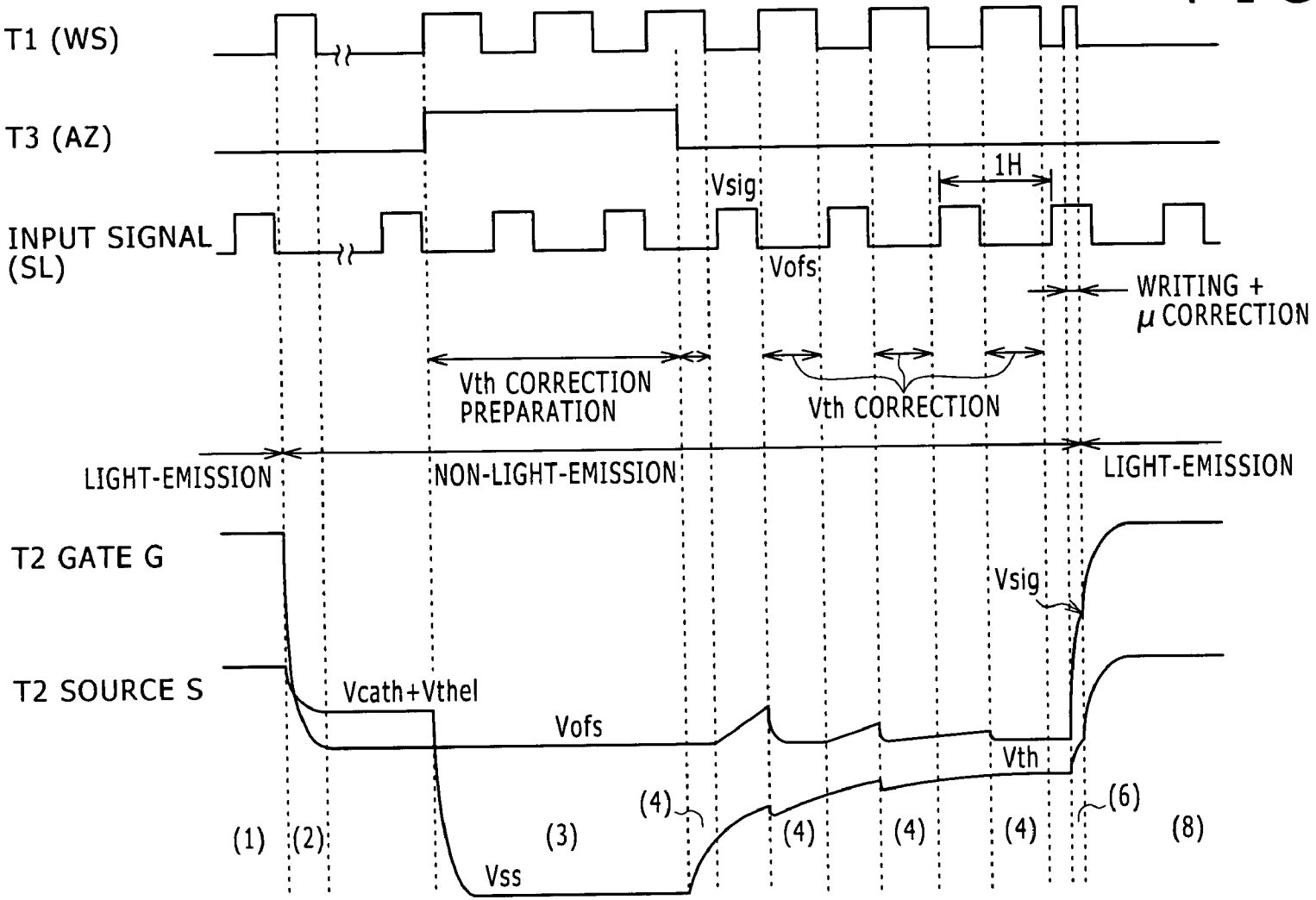
FIG. 3 is a timing chart for explaining the operation of the display device shown in FIGS. 1 and 2.

FIG. 3 is a timing chart for explaining the operation of the display device according to the reference example shown in FIGS. 1 and 2. FIG. 3 shows the waveforms of the control signals supplied to the scan lines WS and AZ. These waveforms correspond to the changes of the states of the sampling transistor T1 and the switching transistor T3 between the on-state and the off-state. In FIG. 3, the waveform of the video signal (input signal) input to the signal line SL is also shown along the same time axis as that of the control signal waveforms. As shown in FIG. 3, the potential of the input signal is switched between the signal potential Vsig and the reference potential Vofs in one horizontal period (1H). Furthermore, the potential changes of the gate G and the source S of the drive transistor T2 are also shown along the same time axis as that of these signal waveforms. In this timing chart, the pixel operation sequence is divided into operation periods (1) to (8) corresponding to the potential changes of the drive transistor T2. These operation periods are as follows, the light-emission period (1), the threshold voltage correction preparation period (3), the threshold voltage correction period (4) that appears plural times in a time-division manner, the writing+mobility correction period (6), and the light-emission period (8). The periods (2) to (6) are included in a non-light-emission period.

With reference to FIGS. 4A to 4H, the operation of the display device according to the previously-developed technique shown in FIGS. 1 to 3 will be described in detail below.

Figure 4A:
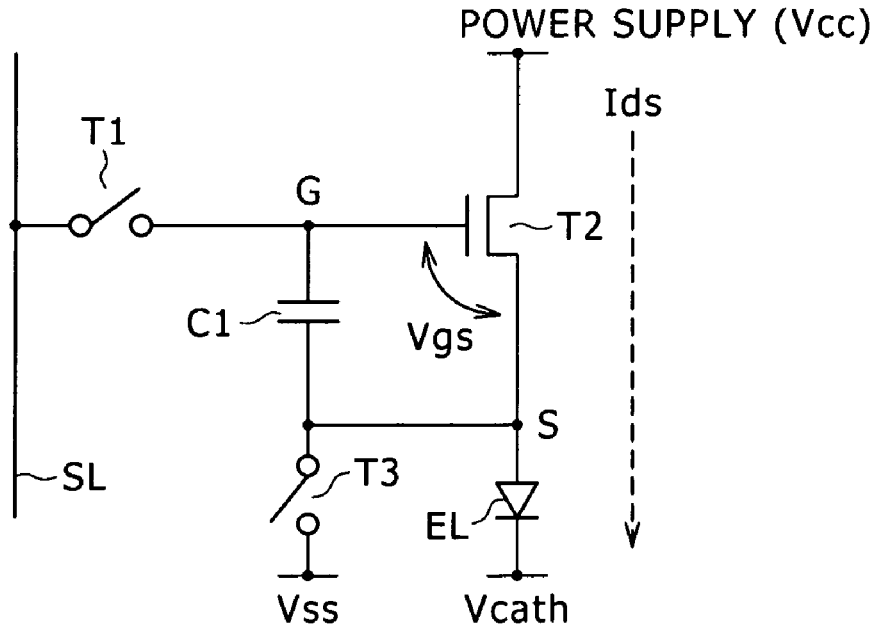
FIG. 4A is a schematic diagram for explaining the operation of a pixel according to the reference example.

FIG. 4A shows the operation state of the pixel in the light-emission period (1) shown in the timing chart of FIG. 3. In the light-emission state of the light-emitting element EL, the sampling transistor T1 and the switching transistor T3 are in the off-state as shown in FIG. 4A. At this time, the current Ids flowing to the light-emitting element EL has the value represented by the above-mentioned transistor characteristic equation depending on the gate-source voltage Vgs of the drive transistor T2 because the drive transistor T2 is so designed as to operate in the saturation region.

Figure 4B:
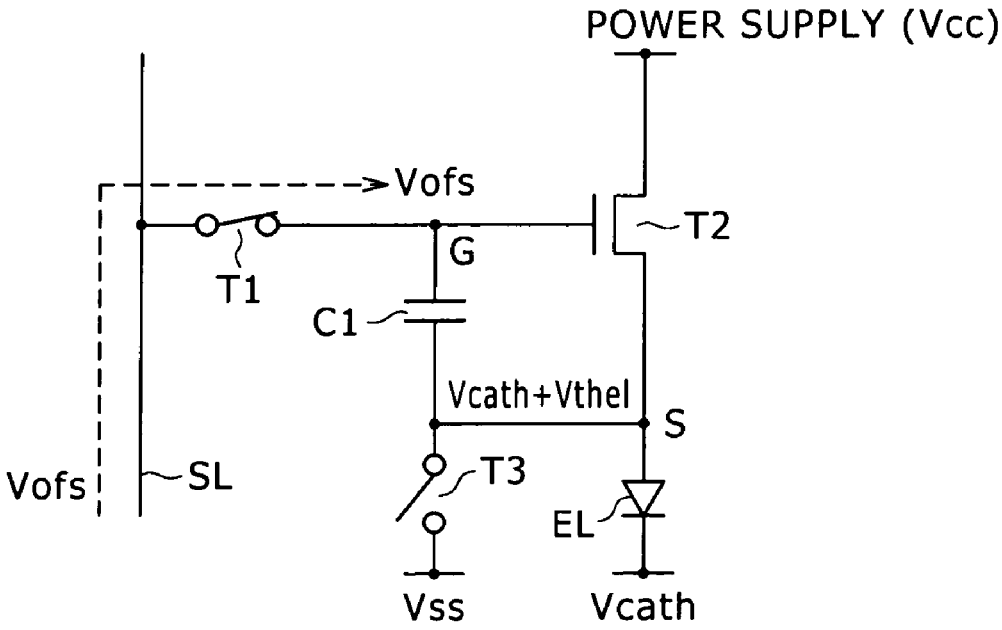
FIG. 4B is a schematic diagram for explaining the operation of the pixel according to the reference example.

FIG. 4B shows the operation state of the pixel in the period (2). In the non-light-emission period, the sampling transistor T1 is turned on when the signal line is at the reference potential Vofs, to thereby set the gate potential of the drive transistor T2 to the reference potential Vofs. Before the sampling transistor T1 is turned on, the light-emitting element EL emits light and therefore the anode voltage of the light-emitting element EL is higher than the sum of the cathode voltage Vcath and the threshold voltage Vthel of the light-emitting element EL. If the sampling transistor T1 is turned on in this state to thereby write the reference potential Vofs to the gate of the drive transistor T2, the gate-source voltage of the drive transistor T2 becomes lower than the threshold voltage Vth thereof. This causes the drive transistor T2 to enter the off-state. Thus, the light-emitting element EL stops the light emission and the anode voltage thereof becomes Vthel+Vcath. After the reference potential Vofs is input to the gate of the drive transistor T2, the sampling transistor T1 is turned off. Stopping the light emission of the light-emitting element EL through such operation can prevent the flowing of excess current from the power supply Vcc to the line of the fixed potential Vss, and thus can reduce the power consumption.

Figure 4C:
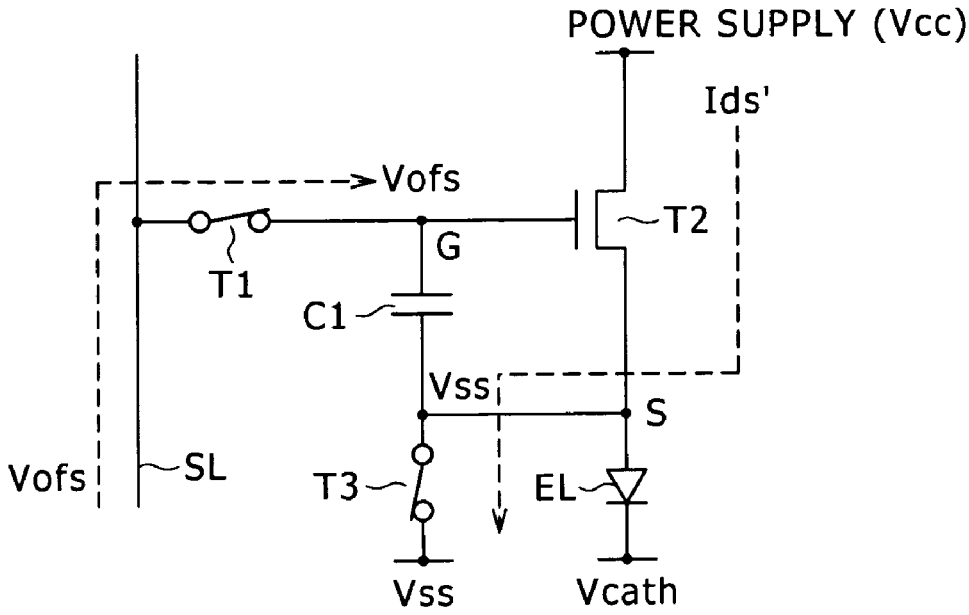
FIG. 4C is a schematic diagram for explaining the operation of the pixel according to the reference example.

FIG. 4C shows the operation state of the pixel in the threshold voltage correction preparation period (3). After the elapse of a certain time, the sampling transistor T1 is turned on again and the switching transistor T3 is turned on when the signal line is at the reference potential Vofs. Either the sampling transistor T1 or the switching transistor T3 may be turned on first. Turning on the sampling transistor T1 inputs the reference potential Vofs to the gate of the drive transistor T2, and turning on the switching transistor T3 inputs the fixed potential Vss to the source of the drive transistor T2. If the fixed potential Vss charged to the source of the drive transistor T2 is lower than the sum of the threshold voltage Vthel and the cathode voltage Vcath of the light-emitting element EL, i.e. the relationship Vss□Vthel+Vcath is satisfied, the light-emitting element EL does not emit light. At this time, the gate-source voltage of the drive transistor T2 is Vofs−Vss. Unless this voltage Vofs−Vss is higher than the threshold voltage Vth of the drive transistor T2, the threshold correction operation may not be carried out. Thus, the relationship Vofs−Vss□Vth should be satisfied. If the relationship Vofs−Vss□Vth is satisfied, a current Ids' corresponding to the above-mentioned transistor characteristic equation flows from the power supply Vcc to the line of the fixed potential Vss. After the elapse of a certain time, the sampling transistor T1 is turned off before the potential of the signal line becomes Vsig. This prevents the signal voltage Vsig from being input to the gate of the drive transistor T2, and thus prevents the flowing of excess current from Vcc to Vss.

Figure 4D:
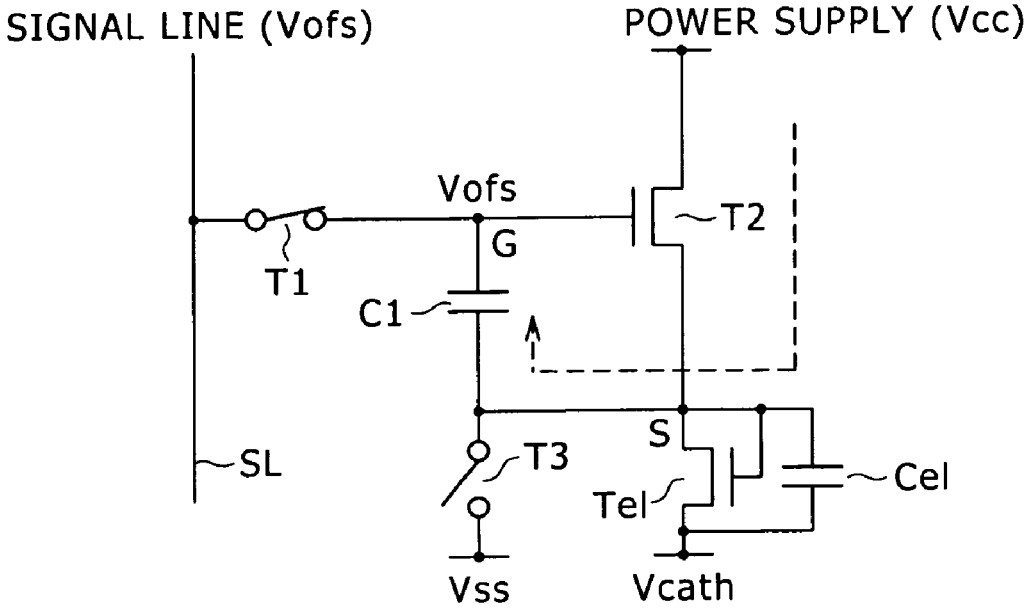
FIG. 4D is a schematic diagram for explaining the operation of the pixel according to the reference example.
Figure 4E:
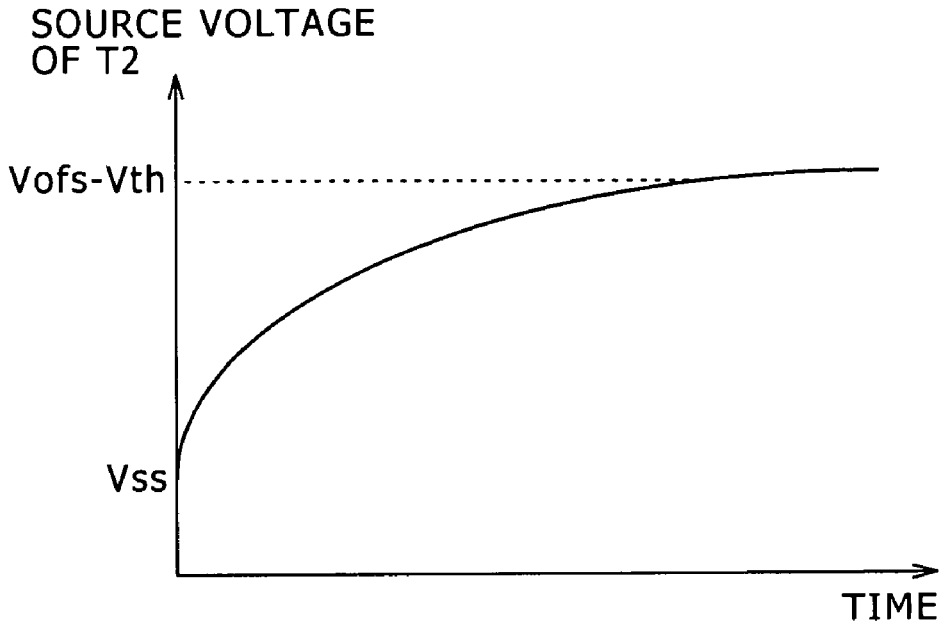
FIG. 4E is a graph for explaining the operation of the pixel according to the reference example.

FIG. 4D shows the operation state of the pixel in the threshold voltage correction period (4). In the threshold correction operation, the sampling transistor T1 is in the on-state and the switching transistor T3 is in the off-state. Thus, a current flows as shown in FIG. 4D. An equivalent circuit of the light-emitting element EL is represented by a diode Tel and a capacitor Cel as shown in FIG. 4D. Therefore, the current through the drive transistor T2 is used to charge the capacitors C1 and Cel as long as the relationship Vel≦Vcath+Vthel is satisfied (the leakage current of the light-emitting element EL is considerably smaller than the current flowing through the drive transistor T2). Vel denotes the anode voltage of the light-emitting element EL and is equivalent to the source voltage of the drive transistor T2. After the elapse of a certain time, the sampling transistor T1 is turned off before the potential of the signal line becomes Vsig. At this time, the threshold correction operation has not yet been completed, and therefore the gate-source voltage of the drive transistor T2 is higher than the threshold voltage Vth of the drive transistor T2. Thus, a current flows from the power supply and both the gate potential and the source potential rise up. When the source potential is lower than Vofs−Vth, the signal line potential is set to the reference potential Vofs again and the sampling transistor T1 is turned on, to thereby carry out the threshold correction operation again. Through the repetition of this operation, Vel increases along with time elapse. FIG. 4E shows change in the source voltage of the drive transistor T2 (i.e. the anode potential Vel of the light-emitting element EL) when the signal line potential is the reference potential Vofs and the sampling transistor T1 is continuously kept at the on-state. After the elapse of a certain time, the gate-source voltage of the drive transistor T2 becomes Vth. At this time, the relationship Vel=Vofs−Vth≦Vcath+Vthel is satisfied.

Figure 4F:
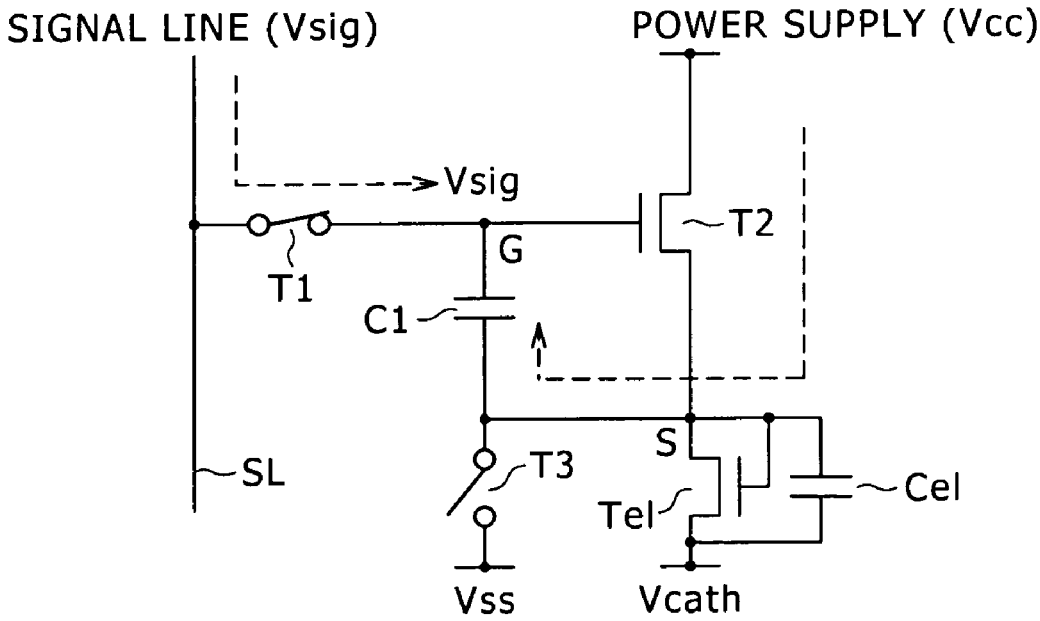
FIG. 4F is a schematic diagram for explaining the operation of the pixel according to the reference example.
Figure 4G:
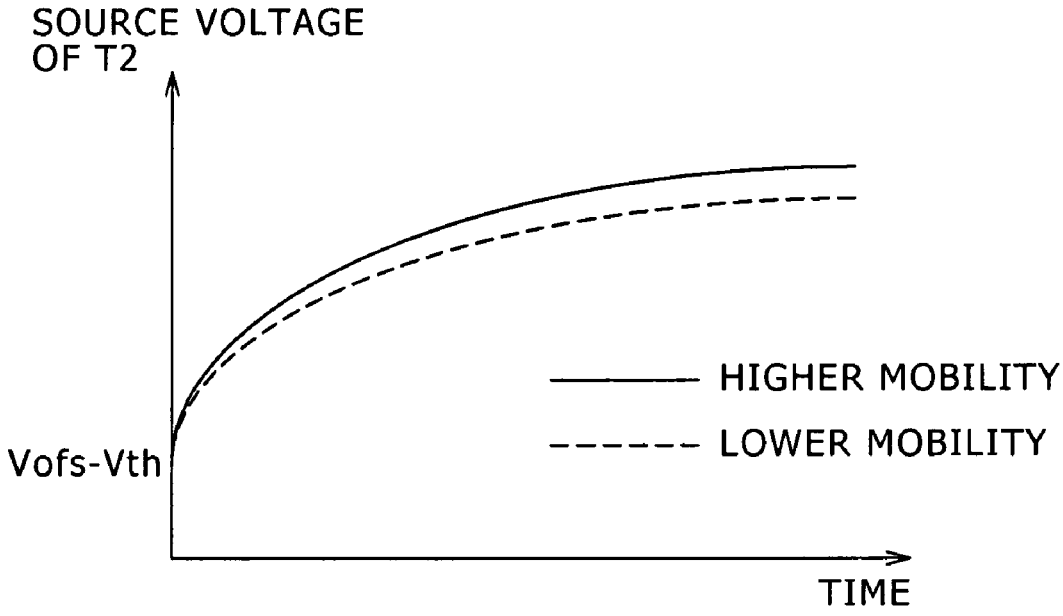
FIG. 4G is a graph for explaining the operation of the pixel according to the reference example.

FIG. 4F shows the operation state of the pixel in the signal writing+mobility correction period (6). After the end of the threshold cancel operation, the sampling transistor T1 is turned off. Subsequently, the sampling transistor T1 is turned on again after the signal line potential becomes Vsig. The gate potential of the drive transistor T2 becomes Vsig because the sampling transistor T1 is turned on. In addition, the source potential rises up along with time elapse because a current flows from the power supply Vcc. At this time, the current through the drive transistor T2 is used to charge the capacitors C1 and Cel unless the source voltage of the drive transistor T2 surpasses the sum of the threshold voltage Vthel and the cathode voltage Vcath of the light-emitting element EL (the leakage current of the light-emitting element EL is considerably smaller than the current flowing through the drive transistor T2). At this time, the threshold correction operation for the drive transistor T2 has been completed, and therefore the current flowing through the drive transistor T2 reflects the mobility μ. Specifically, when the mobility is higher, the current amount at this time is larger and the rising speed of the source potential is also higher. In contrast, when the mobility is lower, the current amount is smaller and the rising speed of the source potential is lower (FIG. 4G). Thus, the gate-source voltage of the drive transistor T2 is so decreased as to reflect the mobility and becomes Vgs resulting from complete correction of the mobility after the elapse of a certain time.

Figure 4H:
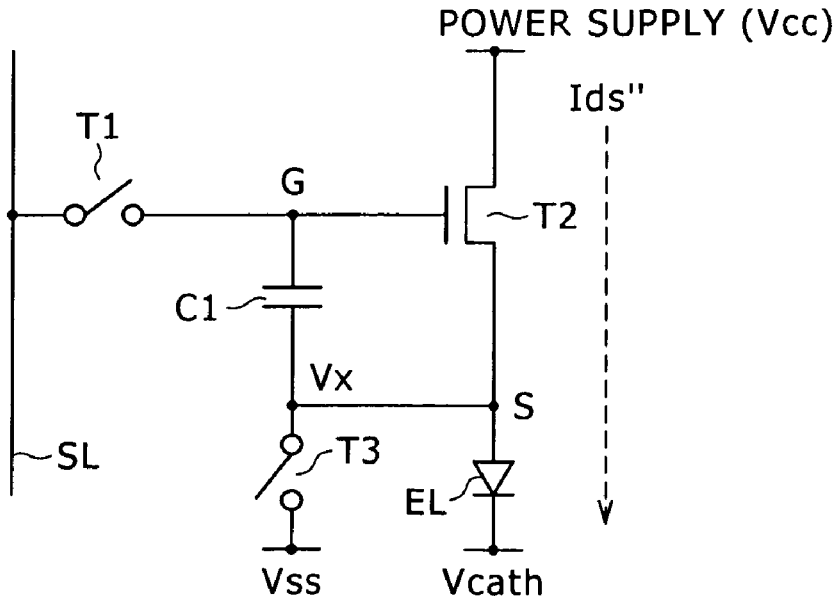
FIG. 4H is a schematic diagram for explaining the operation of the pixel according to the reference example.

FIG. 4H shows the operation state of the pixel in the light-emission period (8). Finally, the sampling transistor T1 is turned off to thereby end the writing and cause the light-emitting element EL to emit light. Because the gate-source voltage of the drive transistor T2 is constant, the drive transistor T2 applies a constant current Ids" to the light-emitting element EL and Vel rises up to a voltage Vx that allows the current Ids" to flow to the light-emitting element EL, so that the light-emitting element EL emits light. Also in this circuit, the I-V characteristic of the light-emitting element EL changes as the total light-emission time thereof becomes longer. Therefore, the potential at the node S in the diagrams also changes. However, because the gate-source voltage of the drive transistor T2 is kept at a constant value, the current flowing through the light-emitting element EL does not change. Therefore, even when the I-V characteristic of the light-emitting element EL deteriorates, the constant current Ids typically flows continuously and hence the luminance of the light-emitting element EL will not change.

In the display device according to the reference example shown in FIGS. 1 to 4, the drive part surrounding the pixel array part includes the additional correction scanner 7 in addition to the write scanner 4. If the drive part includes two vertical scanners in this manner, incorporating these scanners on the same panel as that of the pixel array part causes increase in the frame size of the panel and thus makes it difficult to achieve a high yield. If merely the pixel array part is formed on the panel and the drive part is provided outside the panel based on an external unit structure, the number of gate driver ICs serving as the scanners is increased, which is disadvantageous in terms of the cost.

Figure 5:
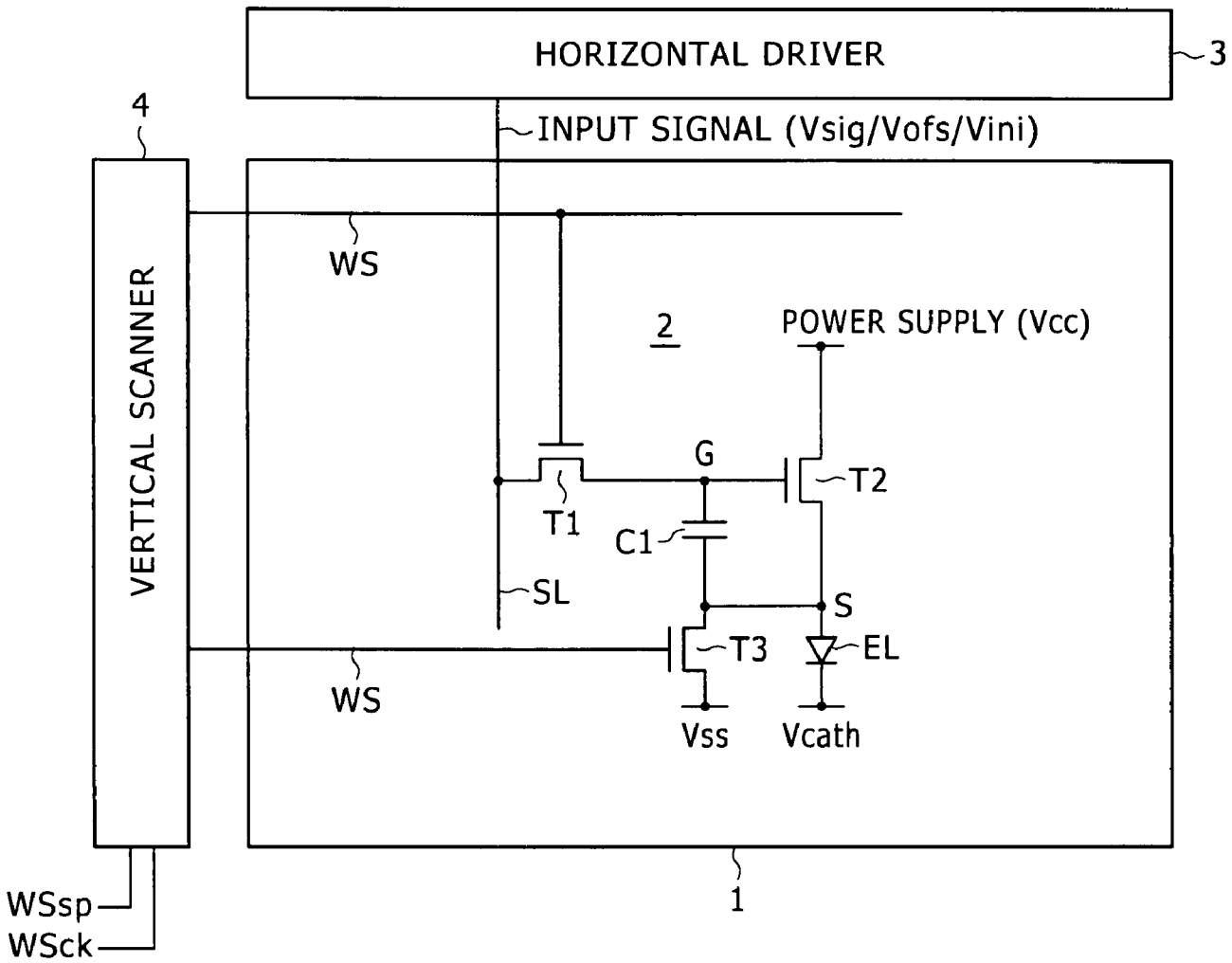
FIG. 5 is a block diagram showing the configuration of a display device according to an embodiment of the present invention.

FIG. 5 is a block diagram showing the circuit configuration of a display device according to the embodiment of the present invention. This display device is to address the problems of the display device according to the previously-developed technique shown in FIGS. 1 to 4. The same part in FIG. 5 as that in the display device according to the previously-developed technique shown in FIG. 2 is given the same reference symbol for easy understanding. As shown in FIG. 5, a pixel circuit 2 includes three transistors and one capacitor as with the previously-developed technique example. On the other hand, the drive part disposed around the pixel array part is composed of a horizontal driver and a vertical scanner. That is, the number of scanners is reduced to one, i.e. the minimum number, differently from the previously-developed technique example. To achieve this configuration, as the control signal for the switching transistor, the control signal for the sampling transistor at a stage that is several stages before the stage (on a row that is several rows before the row) of this switching transistor is used. Furthermore, the input signal (video signal) supplied from the horizontal driver is a three-value pulse. Specifically, the potential of the input signal is switched among the following three levels, the reference potential Vofs, the signal potential Vsig, and a lower potential Vini for reverse bias.

The display device according to the present embodiment is basically composed of a pixel array part 1 and the drive part surrounding it. The pixel array part 1 includes scan lines WS disposed along the rows, signal lines SL disposed along the columns, and the pixels 2 that are disposed at the respective intersections of the scan lines WS and the signal lines SL so as to be arranged in a matrix. The pixel 2 includes at least a sampling transistor T1, a drive transistor T2, a switching transistor T3, a hold capacitor C1, and a light-emitting element EL. The control terminal of the sampling transistor T1 is connected to the scan line WS, and a pair of current terminals thereof are connected between the signal line SL and the control terminal of the drive transistor T2. The current terminal of the drive transistor T2 on the drain side is connected to a power supply Vcc, and the current terminal thereof on the source side is connected to the light-emitting element EL. The light-emitting element EL is a diode-type element. The anode thereof is connected to the source S of the drive transistor T2, and the cathode thereof is coupled to a predetermined cathode potential Vcath. The hold capacitor C1 is connected between the control terminal of the drive transistor T2 as its gate G and the current terminal of the drive transistor T2 on the source side. One of a pair of current terminals of the switching transistor T3 is connected to the current terminal of the drive transistor T2 on the source side, and the other is coupled to a fixed potential Vss. The control terminal of the switching transistor T3 is connected to the scan line WS disposed on a row previous to that of the scan line WS connected to the control terminal of the sampling transistor T1.

The drive part has a vertical scanner 4 and a horizontal driver 3. The driver 3 supplies the video signal (input signal) to the signal lines SL along the columns. The scanner 4 sequentially supplies a control signal to the scan lines WS along the rows to thereby drive the sampling transistors T1 and the switching transistors T3 included in the respective pixels 2. This allows the drive current dependent upon the video signal to be supplied from the drive transistor T2 to the light-emitting element EL. The vertical scanner 4 is basically composed of shift registers. The shift registers operate in response to a clock signal WSck supplied from the external and sequentially transfer a start pulse WSsp supplied from the external similarly, to thereby sequentially supply the control signal to the scan lines WS along the rows. The vertical scanner 4 carries out the line-sequential scanning in the upward direction in the diagram. Therefore, in the pixel 2 on one row, the control signal is supplied to the scan line WS connected to the gate of the switching transistor T3 before the control signal is supplied to the scan line WS connected to the gate of the sampling transistor T1. From another viewpoint, the scan line WS connected to the switching transistor T3 in the pixel 2 on the row of interest is used also as the scan line WS connected to the gate of the sampling transistor T1 in the pixel 2 on a row previous to the row of interest. Due to this configuration, in the display device according to the present embodiment, the vertical scanner 4 can be used for the gate control of both the sampling transistor T1 and the switching transistor T3, and thus the number of scanners can be reduced by one compared with the previously-developed technique example.

It is preferable that the anode of the light-emitting element EL be connected to the source S of the drive transistor T2 and the cathode thereof be coupled to the cathode potential Vcath. In this case, the fixed potential Vss coupled to the current terminal of the switching transistor T3 is lower than the cathode potential Vcath. In specific operation, the vertical scanner 4 carries out correction operation of writing the threshold voltage Vth of the drive transistor T2 to the hold capacitor C1 repeatedly in a time-division manner by driving the sampling transistor T1 and the switching transistor T3. The horizontal driver 3 supplies, to the respective signal lines SL, the video signal whose potential is switched among the reference potential Vofs, the lower potential Vini lower than the reference potential Vofs, and the signal potential Vsig higher than the reference potential Vofs. The reference potential Vofs is applied to the control terminal (gate G) of the drive transistor T2 at the time of the correction operation. The lower potential Vini is applied to the control terminal of the drive transistor T2 after the immediately preceding correction operation and before the start of the next correction operation. The signal potential Vsig is applied to the control terminal of the drive transistor T2 after the completion of the last correction operation. The switching transistor T3 is turned on at the preparatory stage previous to the correction operation to thereby apply the fixed potential Vss to the current terminal of the drive transistor T2 on the source side.

Figure 6:
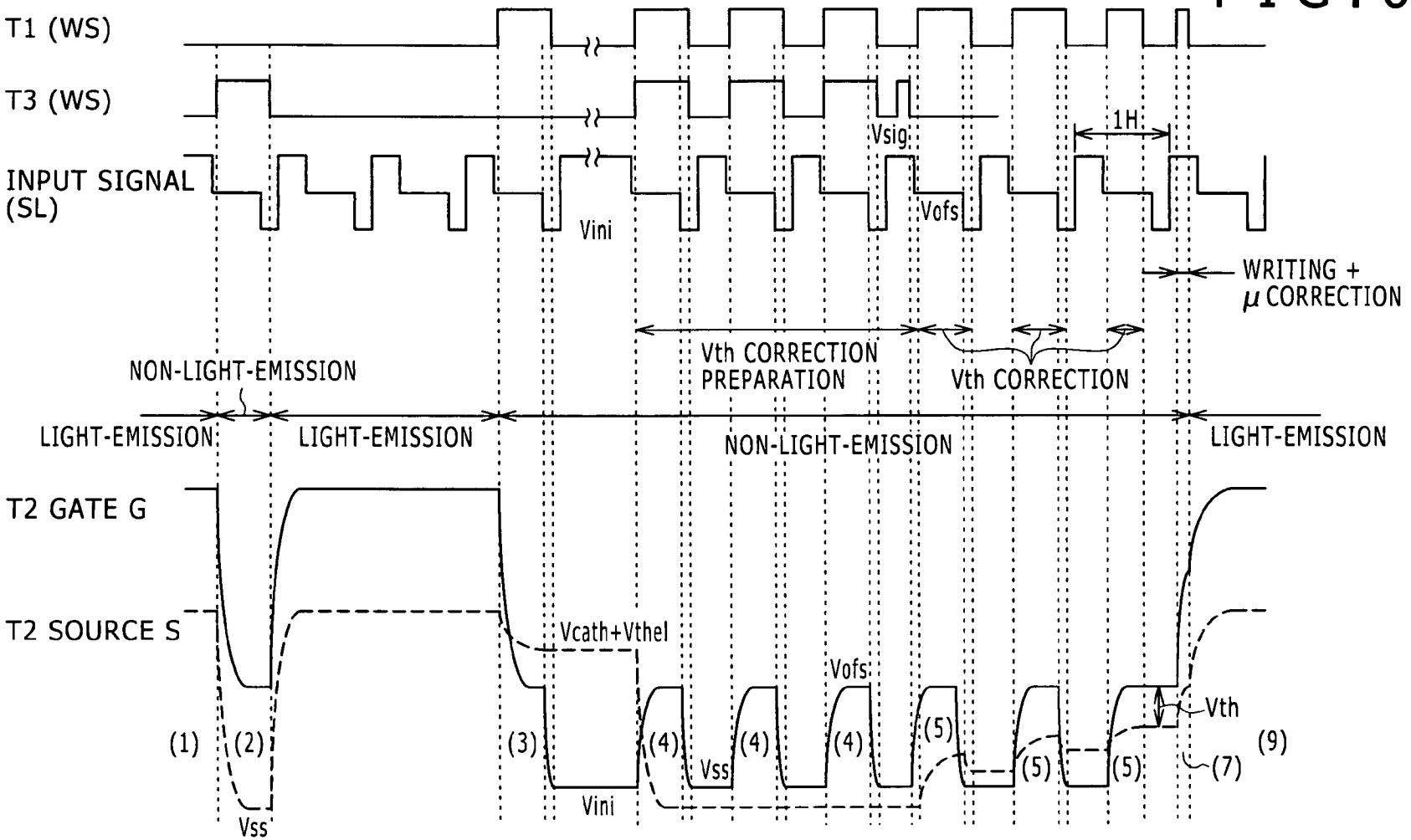
FIG. 6 is a timing chart for explaining the operation of the display device according to the embodiment.

FIG. 6 is a timing chart for explaining the operation of the display device according to the present embodiment shown in FIG. 5. For the timing chart of FIG. 6, the same representation manner as that of the timing chart shown in FIG. 3 is employed for easy understanding. As shown in FIG. 6, the state of the sampling transistor T1 is switched between the on-state and the off-state repeatedly in response to the control signal applied to the scan line WS. Similarly, the state of the switching transistor T3 is also switched between the on-state and the off-state repeatedly in response to the control signal applied to the scan line WS on a previous row. As is apparent from the timing chart, the phase of the control signal applied to the gate of the switching transistor T3 is forward shifted by 3H from that of the control signal applied to the gate of the sampling transistor T1. However, the waveforms of the control signals are identical to each other because the control signals arise from the sequential transferring of the start signal waveform supplied from the external. As is apparent from this description, in the present embodiment, connected to the gate of the switching transistor T3 is the scan line WS on the row that is three rows before the row of this switching transistor T3. However, the embodiment of the present invention is not limited thereto, but the scan line on the row that is the proper number of rows before the row of the switching transistor T3 can be used for the gate control of the switching transistor T3 depending on the operating condition.

The video signal (input signal) input to the signal line SL is a three-value pulse, and the potential thereof is switched among the signal potential Vsig, the reference potential Vofs, and the lower potential Vini in 1H. In response to these changes in the control signal waveforms and the input signal waveform, the potentials of the gate G and the source S of the drive transistor T2 change as shown in FIG. 6. Corresponding to these changes, the pixel operation sequence is divided into periods (1) to (9). Specifically, this operation sequence includes the light-emission period (1), the non-light-emission period (2), the light-emission-stop period (3), the threshold voltage correction preparation period (4) repeated plural times, the threshold voltage correction period (5) repeated plural times, the signal writing+mobility correction period (7), and the light-emission period (9). The period from the light-emission-stop period (3) until the start of the light-emission period (9) is a non-light-emission period. In this non-light-emission period, threshold voltage correction preparation operation, threshold voltage correction operation, and signal writing operation are carried out.

Figure 7A:
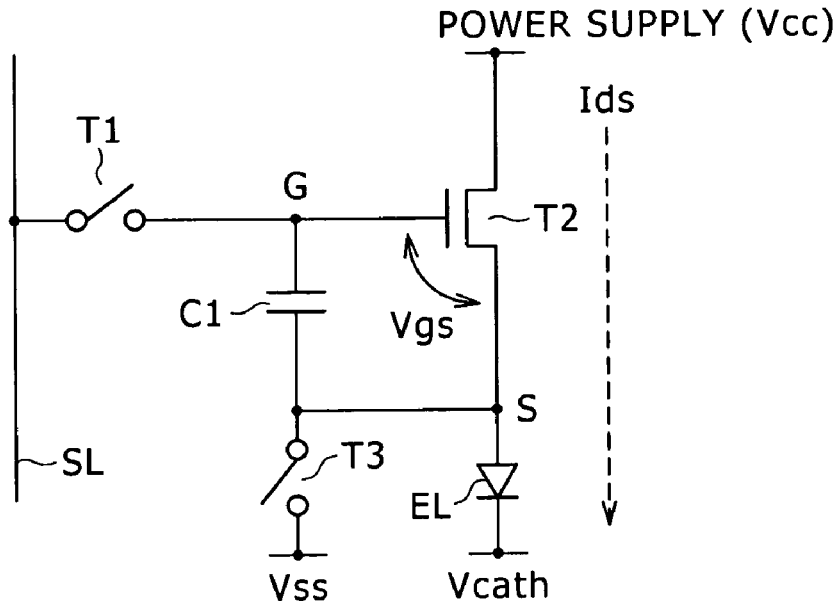
FIG. 7A is a schematic diagram for explaining the operation of the display device according to the embodiment.

With reference to FIGS. 7A to 7I, the operation of the display device according to the present embodiment shown in FIGS. 5 and 6 will be described in detail below. In the light-emission period (1) of the light-emitting element EL, the sampling transistor T1 and the switching transistor T3 are in the off-state as shown in FIG. 7A. At this time, the current Ids flowing to the light-emitting element EL has the value represented by the above-mentioned transistor characteristic equation depending on the gate-source voltage Vgs of the drive transistor T2 because the drive transistor T2 is so designed as to operate in the saturation region.

Figure 7B:
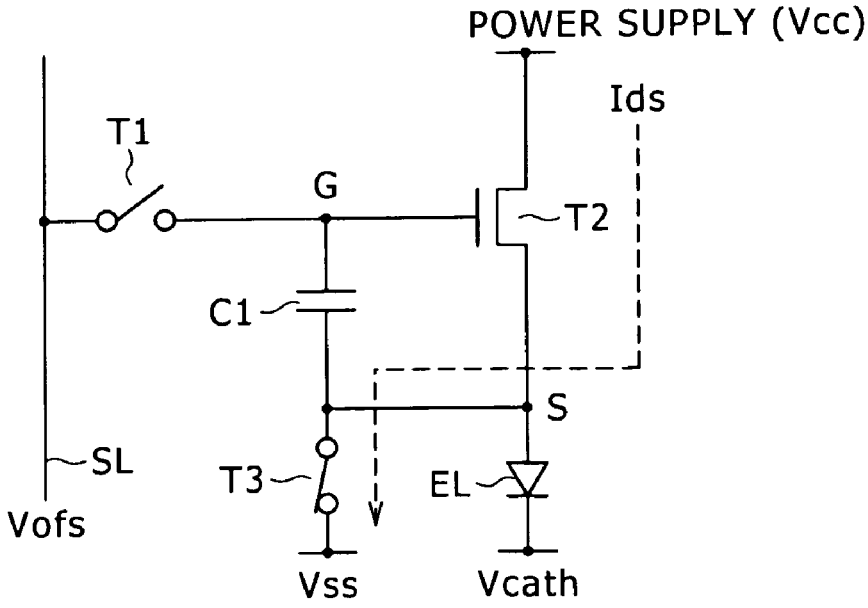
FIG. 7B is a schematic diagram for explaining the operation of the display device according to the embodiment.

In the non-light-emission period (2), the switching transistor T3 is turned on, before the sampling transistor T1 is turned on (FIG. 7B). This is because the scan line for the sampling transistor T1 on a row that is several rows before the row of this turned-on switching transistor T3 is used as the scan line for this switching transistor T3. Turning on the switching transistor T3 sets the source potential of the drive transistor T2 to the fixed potential Vss. Because the fixed potential Vss is set lower than the sum of the threshold voltage Vthel and the cathode voltage Vcath of the light-emitting element EL, the current Ids flows into the line of the fixed potential Vss. At this time, the gate-source voltage Vgs of the drive transistor T2 is kept constant because the sampling transistor T1 is not turned on.

Figure 7C:
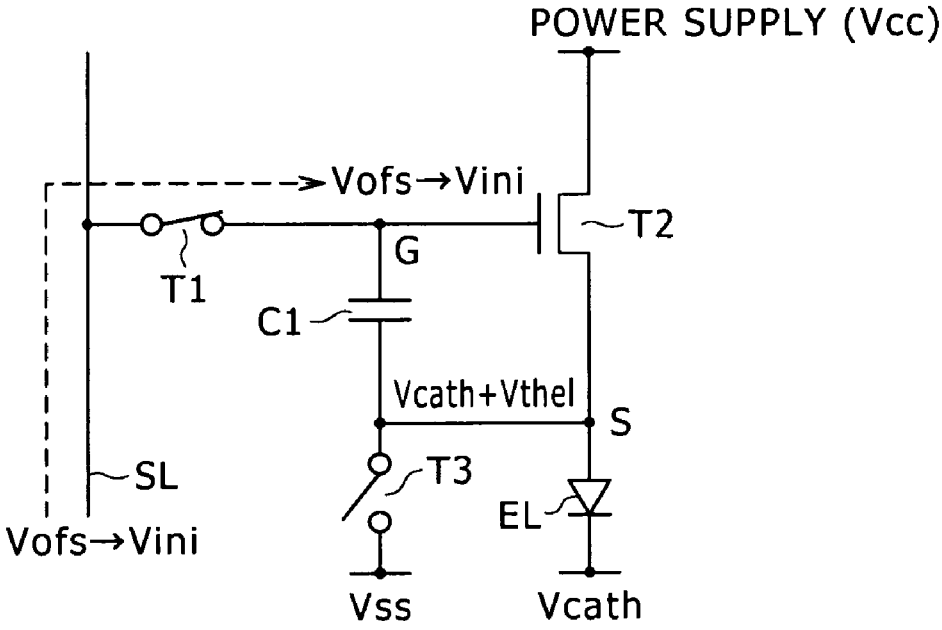
FIG. 7C is a schematic diagram for explaining the operation of the display device according to the embodiment.

In the light-emission-stop period (3), the sampling transistor T1 is turned on when the signal line is at the reference potential Vofs, to thereby set the gate potential of the drive transistor T2 to the reference potential Vofs (FIG. 7C). Before the sampling transistor T1 is turned on, the light-emitting element EL emits light and therefore the anode voltage of the light-emitting element EL is higher than the sum of the cathode voltage Vcath and the threshold voltage Vthel of the light-emitting element EL. If the sampling transistor T1 is turned on in this state to thereby write the reference potential Vofs to the gate of the drive transistor T2, the gate-source voltage of the drive transistor T2 becomes lower than the threshold voltage Vth thereof. This causes the drive transistor T2 to enter the off-state. Thus, the light-emitting element EL stops the light emission and the anode voltage thereof becomes Vthel+Vcath. Subsequently, the signal line potential changes from the reference potential Vofs to the lower potential Vini, so that the lower potential Vini is input to the gate of the drive transistor T2. Inputting the lower potential Vini makes the gate-source voltage Vgs of the drive transistor T2 lower than the threshold voltage Vth thereof. Thus, the light-emitting element EL will not emit light even when the sampling transistor T1 is turned off. After the inputting of the lower potential Vini, the sampling transistor T1 is turned off.

Figure 7D:
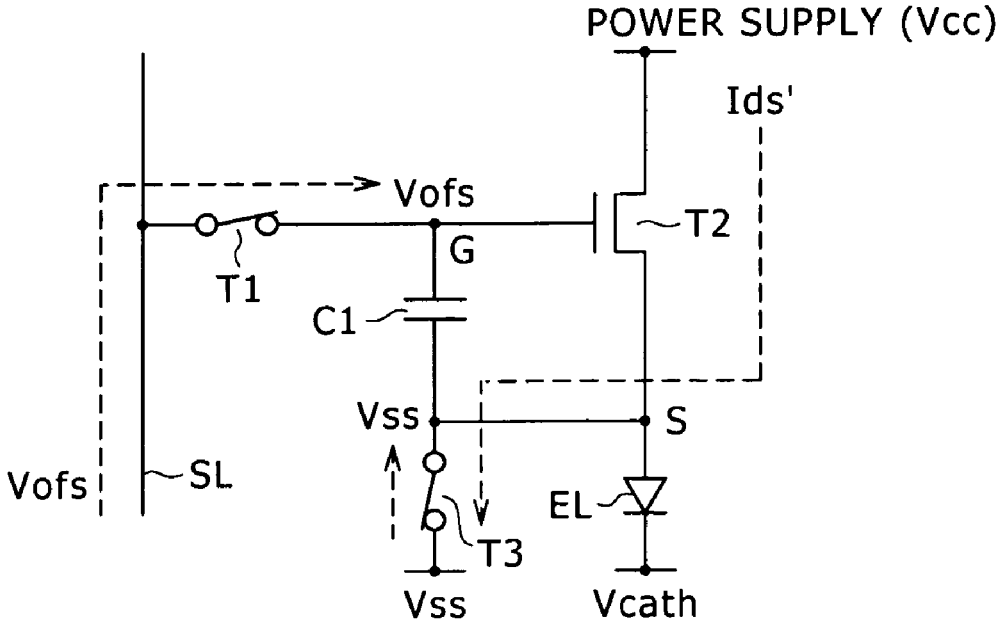
FIG. 7D is a schematic diagram for explaining the operation of the display device according to the embodiment.

At the start timing of the threshold voltage correction preparation period (4) after the elapse of a certain time, the sampling transistor T1 is turned on again and the switching transistor T3 is turned on when the signal line potential is the reference potential Vofs (FIG. 7D). Turning on the sampling transistor T1 inputs the reference potential Vofs to the gate of the drive transistor T2, and turning on the switching transistor T3 inputs the fixed potential Vss to the source of the drive transistor T2. If the fixed potential Vss charged to the source of the drive transistor T2 is lower than the sum of the threshold voltage Vthel and the cathode voltage Vcath of the light-emitting element EL, i.e. the relationship Vss□Vthel+Vcath is satisfied, the light-emitting element EL does not emit light. At this time, the gate-source voltage of the drive transistor T2 is Vofs−Vss. Unless this voltage Vofs−Vss is higher than the threshold voltage Vth of the drive transistor T2, the threshold correction operation may not be carried out. Thus, the relationship Vofs−Vss□Vth should be satisfied. If the relationship Vofs−Vss□Vth is satisfied, a current Ids' corresponding to the above-mentioned transistor characteristic equation flows from the power supply Vcc to the line of the fixed potential Vss. After the elapse of a certain time, the signal line potential is set to the lower potential Vini to thereby set Vgs of the drive transistor T2 lower than Vth. Thereafter, the sampling transistor T1 is turned off before the signal line potential becomes Vsig. This prevents the flowing of excess current from the power supply Vcc to the line of the fixed potential Vss.

Figure 7E:
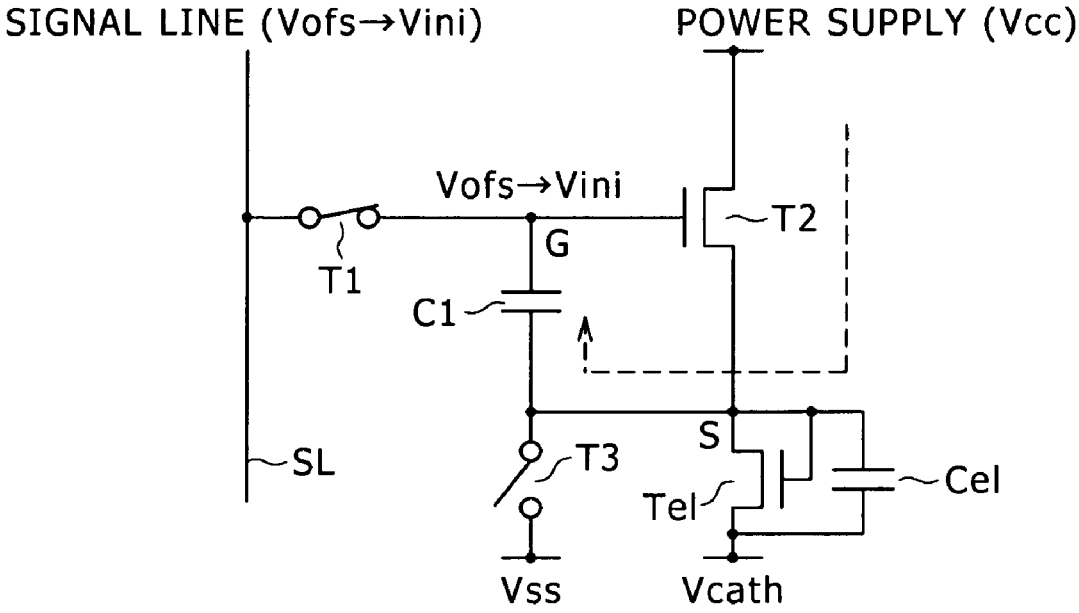
FIG. 7E is a schematic diagram for explaining the operation of the display device according to the embodiment.

After the above-described operation is repeated plural times, in the threshold correction period (5), the sampling transistor T1 is turned on when the signal line SL is at the reference potential Vofs. Thus, a current flows as shown in FIG. 7E. An equivalent circuit of the light-emitting element EL is represented by a diode and a capacitor as shown in FIG. 7E. Therefore, the current through the drive transistor T2 is used to charge the capacitors C1 and Cel as long as the relationship Vel≦Vcath+Vthel is satisfied (the leakage current of the light-emitting element EL is considerably smaller than the current flowing through the drive transistor T2). After the elapse of a certain time, the signal line potential is set to the lower potential Vini to thereby set Vgs of the drive transistor T2 lower than Vth. Thereafter, the sampling transistor T1 is turned off before the signal line potential becomes Vsig. Due to this operation, if the Vth correction operation has not yet been completed, Vgs of the drive transistor T2 becomes higher than Vth and the threshold correction operation is carried out merely when the sampling transistor T1 is turned on. Through the repetition of this operation, Vel increases along with time elapse.

Figure 7F:
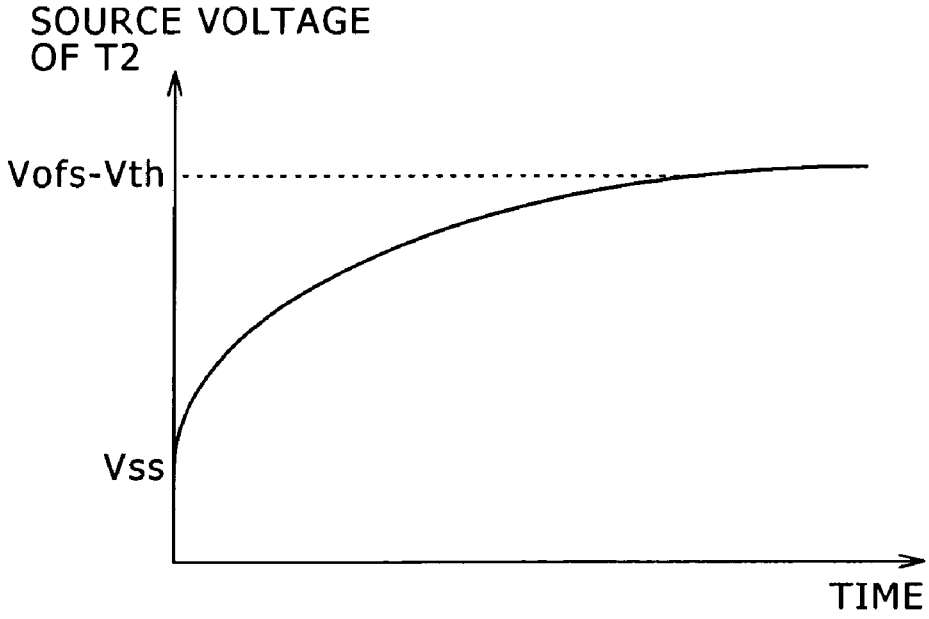
FIG. 7F is a graph for explaining the operation of the display device according to the embodiment.

FIG. 7F shows change in the source voltage of the drive transistor T2 (i.e. the anode voltage Vel of the light-emitting element EL) when the signal line potential is the reference potential Vofs and the sampling transistor T1 is continuously kept at the on-state. After the elapse of a certain time, the gate-source voltage of the drive transistor T2 becomes Vth. At this time, the relationship Vel=Vofs−Vth≦Vcath+Vthel is satisfied. As the operation for the threshold voltage correction, the sampling transistor T1 may be turned off when the signal line potential is at the reference potential Vofs to thereby allow bootstrap operation during the period between the previous and subsequent threshold correction operation periods, like in the above-described operation sequence. After the threshold correction immediately before writing, the sampling transistor T1 is turned off before the signal line potential becomes the lower potential Vini.

Figure 7G:
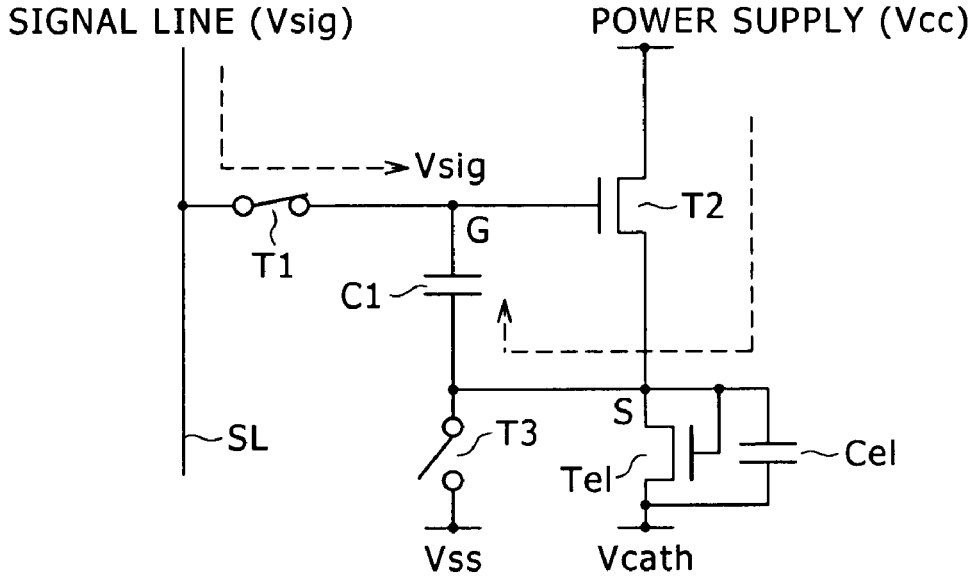
FIG. 7G is a schematic diagram for explaining the operation of the display device according to the embodiment.
Figure 7H:
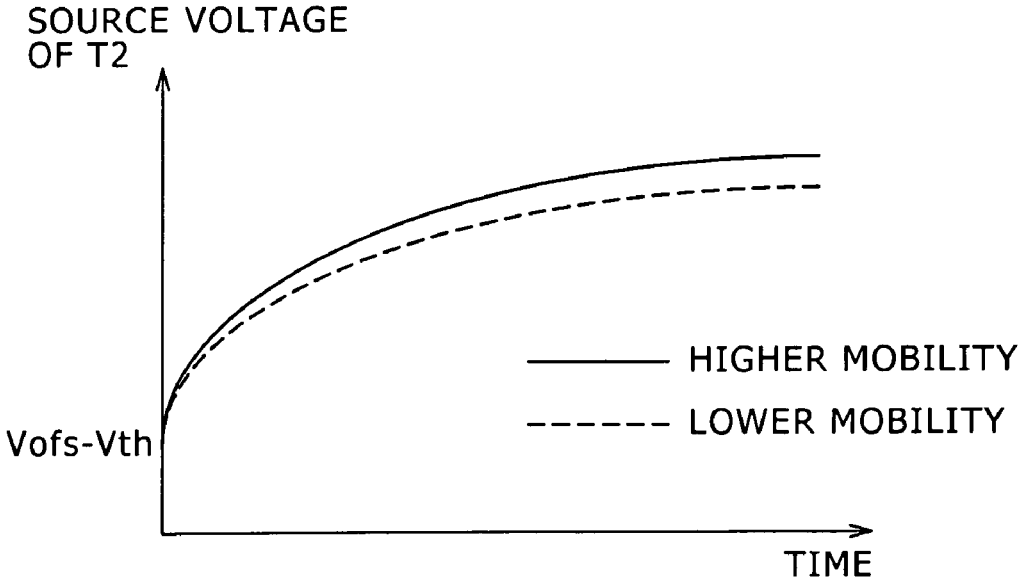
FIG. 7H is a graph for explaining the operation of the display device according to the embodiment.

In the signal writing period (7), the sampling transistor T1 is turned on again after the signal line potential is set to Vsig (FIG. 7G). The gate potential of the drive transistor T2 becomes Vsig because the sampling transistor T1 is turned on. In addition, the source potential rises up along with time elapse because a current flows from the power supply Vcc. At this time, the current through the drive transistor T2 is used to charge the capacitors C1 and Cel unless the source voltage of the drive transistor T2 surpasses the sum of the threshold voltage Vthel and the cathode voltage Vcath of the light-emitting element EL (the leakage current of the light-emitting element EL is considerably smaller than the current flowing through the drive transistor T2). At this time, the threshold correction operation for the drive transistor T2 has been completed, and therefore the current flowing through the drive transistor T2 reflects the mobility μ. Specifically, when the mobility is higher, the current amount at this time is larger and the rising speed of the source potential is also higher. In contrast, when the mobility is lower, the current amount is smaller and the rising speed of the source potential is lower (FIG. 7H). Thus, the gate-source voltage of the drive transistor T2 is so decreased as to reflect the mobility and becomes Vgs resulting from complete correction of the mobility after the elapse of a certain time.

Figure 7I:
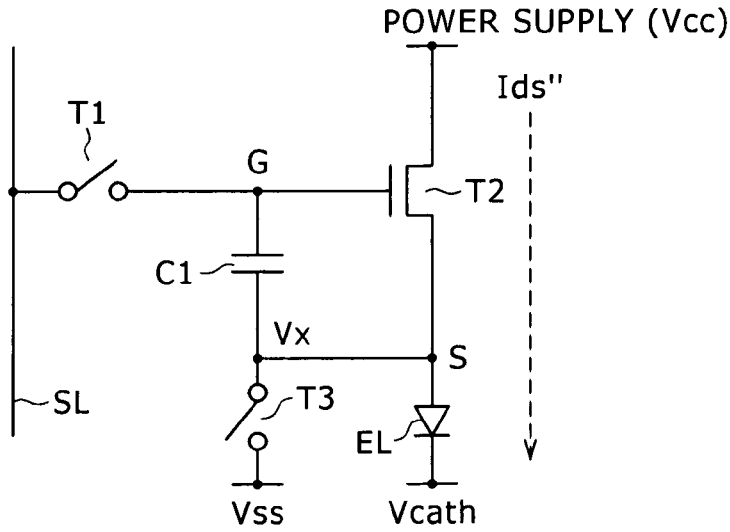
FIG. 7I is a schematic diagram for explaining the operation of the display device according to the embodiment.

When the sampling transistor T1 is turned off and thus the writing is ended, the light-emission period (9) starts and thereupon the light-emitting element EL is caused to emit light. Because the gate-source voltage of the drive transistor T2 is constant, the drive transistor T2 applies a constant current Ids" to the light-emitting element EL and Vel rises up to a voltage Vx that allows the current Ids" to flow to the light-emitting element EL, so that the light-emitting element EL emits light (FIG. 7I). The present embodiment can reduce the number of scanners or gate drivers provided outside the pixel area, which allows reduction in the frame size and the cost.

As described above, the embodiment of the present invention can suppress variation in the threshold voltage of the drive transistor T2 and thus can achieve uniform image quality free from unevenness and graininess. The embodiment of the present invention can reduce the number of built-in scanners or external scanner ICs provided outside the pixel area of the panel and thus can reduce the frame size and the cost. In the embodiment of the present invention, the gate-source voltage of the drive transistor T2 is kept at a constant value, and thus the current flowing through the light-emitting element EL does not change. Therefore, even when the I-V characteristic of the light-emitting element EL deteriorates, the constant current Ids typically flows continuously and hence the luminance of the light-emitting element EL will not change.

Figure 8:
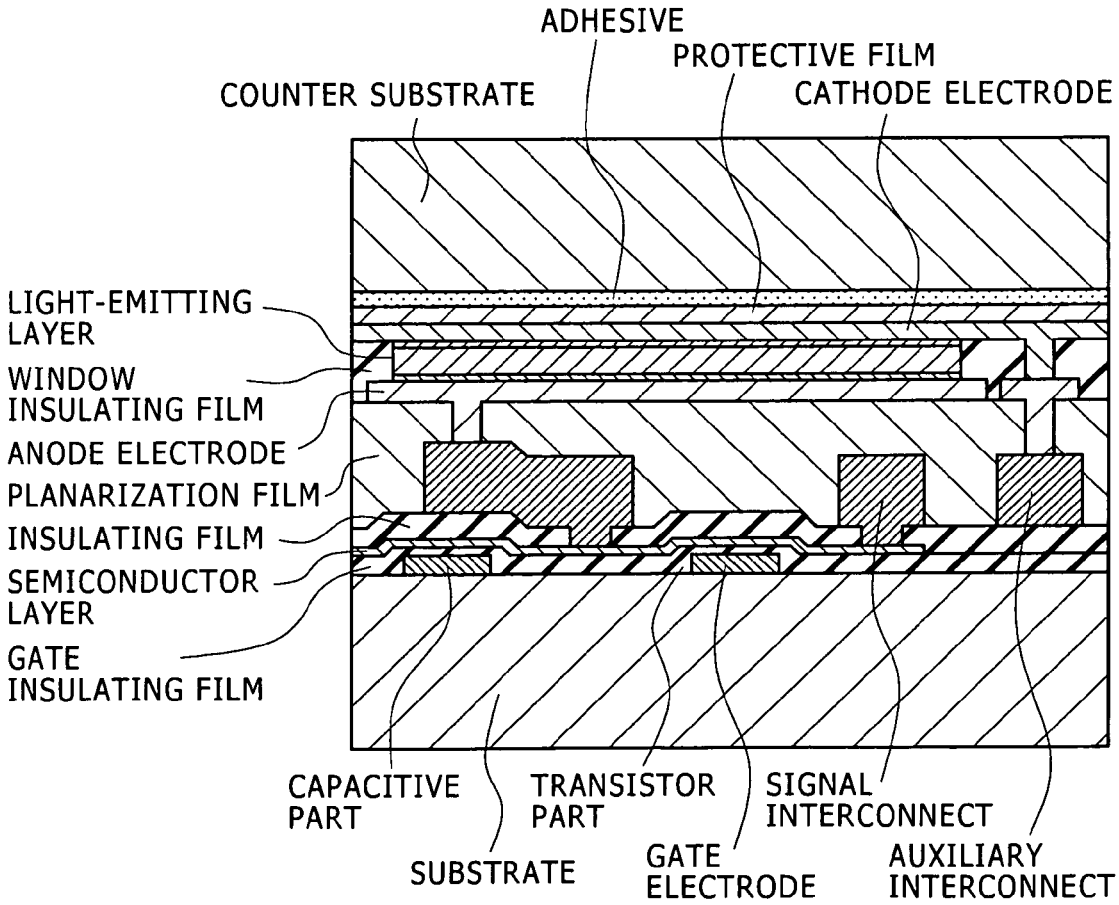
FIG. 8 is a sectional view showing a device structure of the display device according to the embodiment.

The display device according to the embodiment of the present invention has a thin film device structure like that shown in FIG. 8. FIG. 8 shows the schematic sectional structure of a pixel formed over an insulating substrate. As shown in FIG. 8, the pixel includes a transistor part having plural thin film transistors (merely one TFT is shown in FIG. 8), a capacitive part such as a hold capacitor, and a light-emitting part such as an organic EL element. The transistor part and the capacitive part are formed on the substrate by a TFT process, and the light-emitting part such as an organic EL element is stacked thereon. A counter substrate is attached over the light-emitting part with the intermediary of an adhesive, so that a flat panel is obtained.

Figure 9:
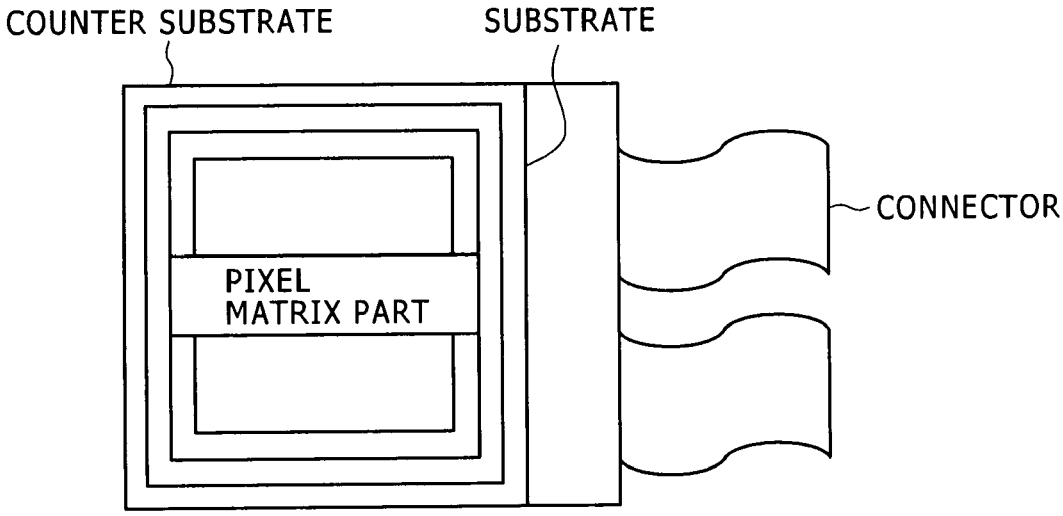
FIG. 9 is a plan view showing a module structure of the display device according to the embodiment.

The display device according to the embodiment of the present invention encompasses a display module having a flat module shape like that shown in FIG. 9. For example, the display module is obtained as follows. A pixel array part in which pixels each including an organic EL element, thin film transistors, a thin film capacitor, and so on are integrally formed into a matrix is provided on an insulating substrate. Furthermore, an adhesive is so disposed as to surround this pixel array part (pixel matrix part), and a counter substrate composed of glass or the like is bonded to the substrate. This transparent counter substrate may be provided with e.g. a color filter, protective film, and light-blocking film according to need. The display module may be provided with e.g. a flexible printed circuit (FPC) as a connector for inputting/outputting of signals and so forth to/from the pixel array part from/to the external.

The display device according to the above-described embodiment can be applied to a display that has a flat panel shape and is incorporated in various kinds of electronic apparatus in any field that displays image or video based on a video signal input to the electronic apparatus or produced in the electronic apparatus, such as a digital camera, notebook personal computer, cellular phone, and video camera. Examples of such electronic apparatus to which the display device is applied will be described below.

Figure 10:
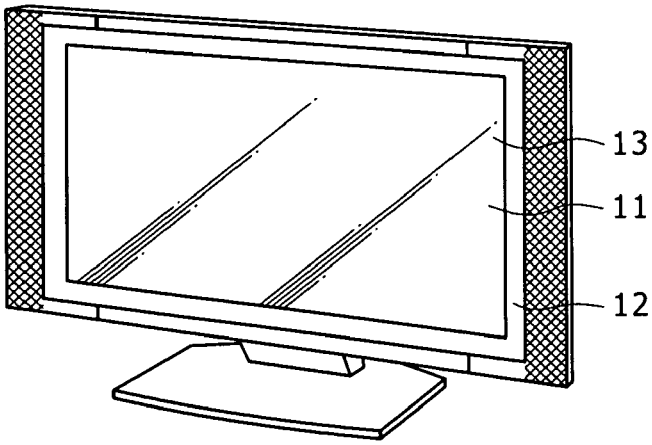
FIG. 10 is a perspective view showing a television set including the display device according to the embodiment.

FIG. 10 shows a television to which the embodiment of the present invention is applied. This television includes a video display screen 11 composed of a front panel 12, a filter glass 13, and so on, and is fabricated by using the display device according to the embodiment of the present invention as the video display screen 11.

Figure 11:
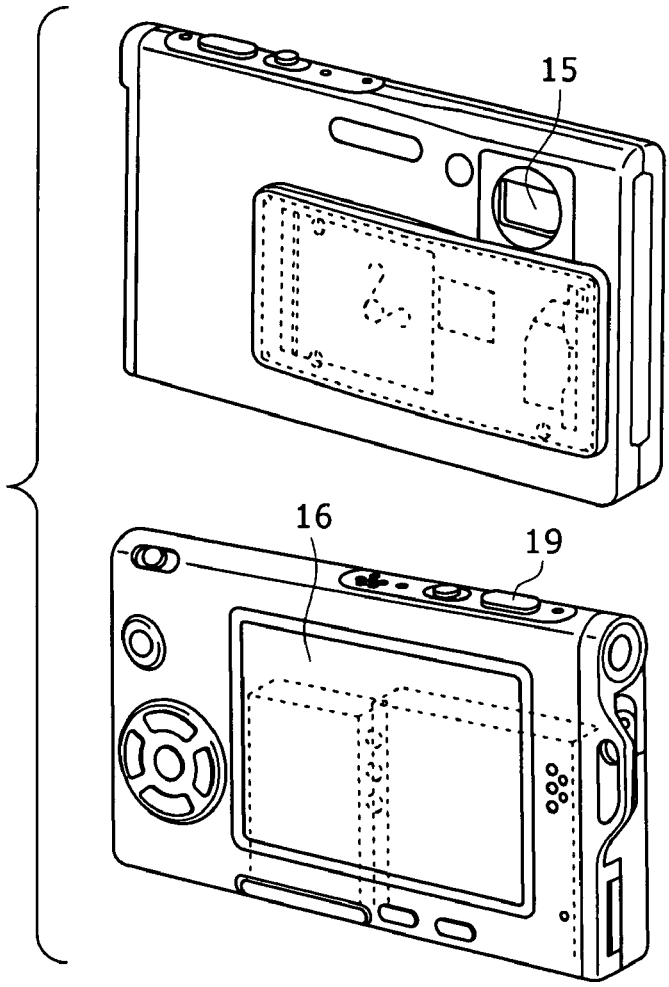
FIG. 11 is a perspective view showing a digital still camera including the display device according to the embodiment.

FIG. 11 shows a digital camera to which the embodiment of the present invention is applied, the upper diagram is a front view and the lower diagram is a rear view. This digital camera includes an imaging lens, a light emitter 15 for flash, a display part 16, a control switch, a menu switch, a shutter button 19, and so on, and is fabricated by using the display device according to the embodiment of the present invention as the display part 16.

Figure 12:
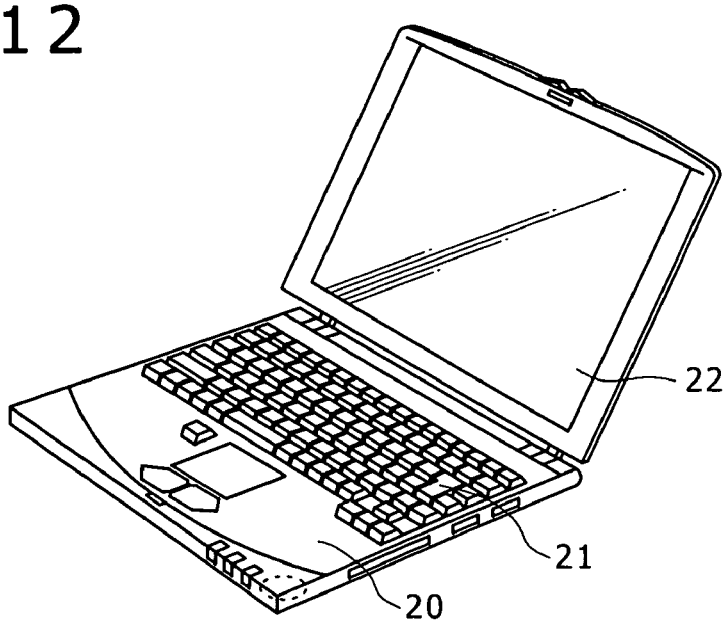
FIG. 12 is a perspective view showing a notebook personal computer including the display device according to the embodiment.

FIG. 12 shows a notebook personal computer to which the embodiment of the present invention is applied. A main body 20 thereof includes a keyboard 21 that is operated in inputting of characters and so on, and the body cover thereof includes a display part 22 for image displaying. This notebook personal computer is fabricated by using the display device according to the embodiment of the present invention as the display part 22.

Figure 13:
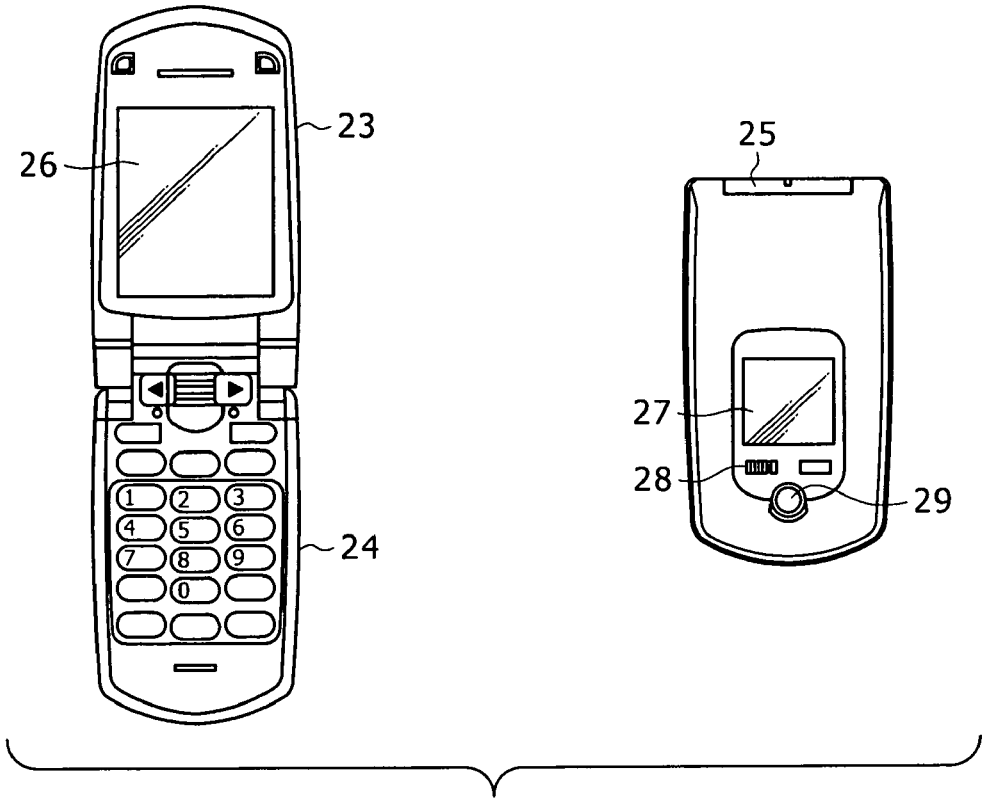
FIG. 13 is a schematic diagram showing portable terminal apparatus including the display device according to the embodiment.

FIG. 13 shows portable terminal apparatus to which the embodiment of the present invention is applied, the left diagram shows the opened state and the right diagram shows the closed state. This portable terminal apparatus includes an upper casing 23, a lower casing 24, a connection (hinge) 25, a display 26, a sub-display 27, a picture light 28, a camera 29, and so on. This portable terminal apparatus is fabricated by using the display device according to the embodiment of the present invention as the display 26 and the sub-display 27.

Figure 14:
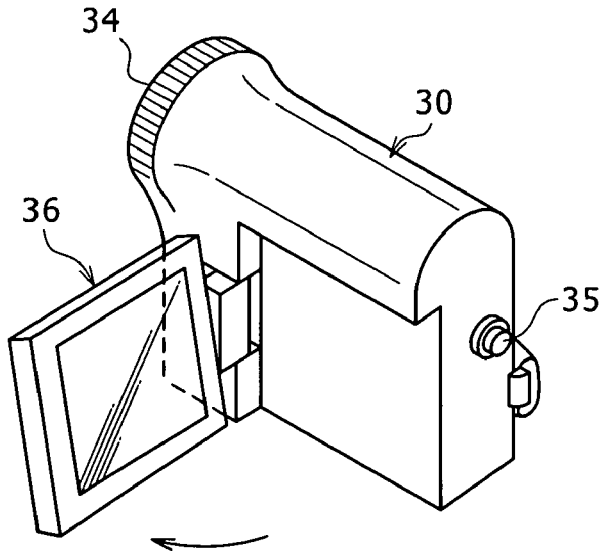
FIG. 14 is a perspective view showing a video camera including the display device according to the embodiment.
Figure 15:
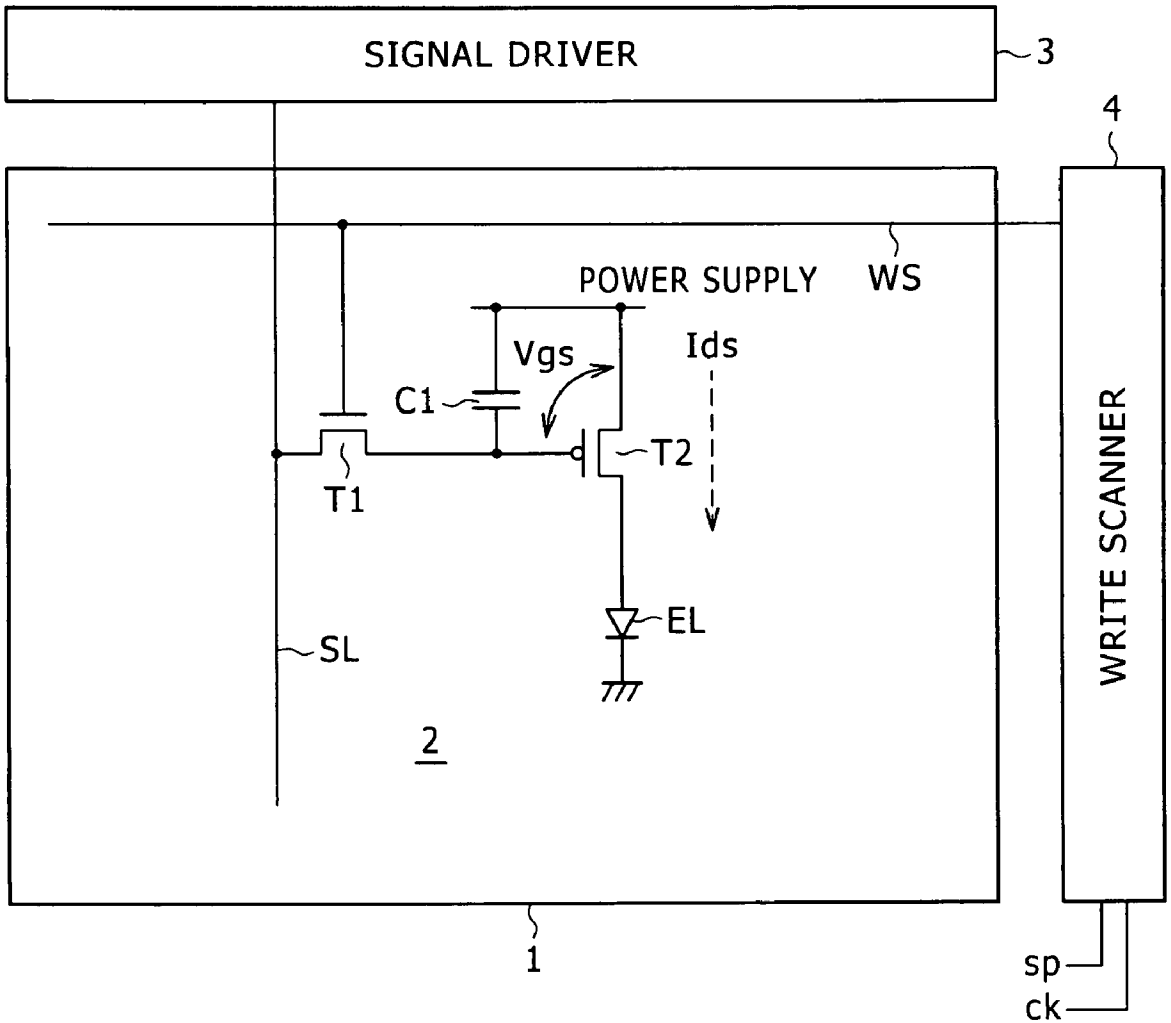
FIG. 15 is a circuit diagram showing one example of a related-art display device.
Figure 16:
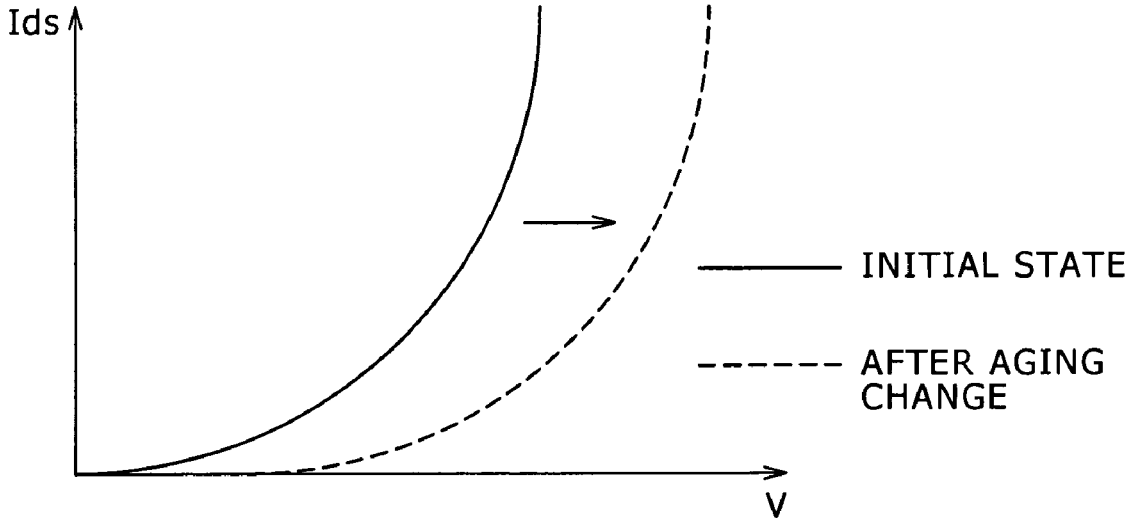
FIG. 16 is a graph showing a problem in the related-art display device.
Figure 17:
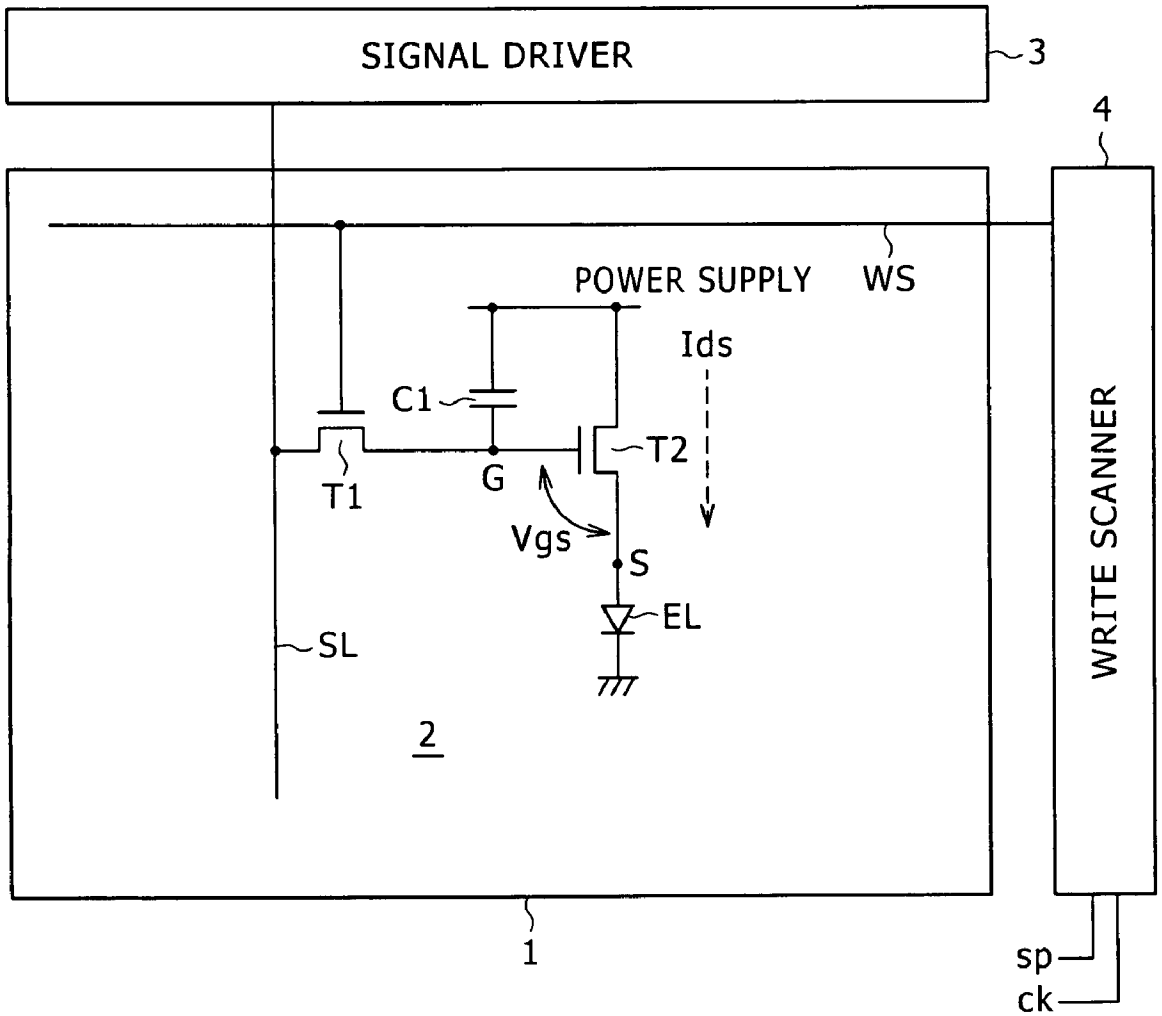
FIG. 17 is a circuit diagram showing another example of the related-art display device.

FIG. 14 shows a video camera to which the embodiment of the present invention is applied. This video camera includes a main body 30, a lens 34 that is disposed on the front side of the camera and used to capture a subject image, a start/stop switch 35 for imaging operation, a monitor 36, and so on. This video camera is fabricated by using the display device according to the embodiment of the present invention as the monitor 36.

It should be understood by those skilled in the art that various modifications, combinations, sub-combinations and alterations may occur depending on design requirements and other factor in so far as they are within the scope of the appended claims or the equivalents thereof.

What is claimed is:

1. A display device comprising:

a pixel array part configured to include scan lines disposed along rows, signal lines disposed along columns, and pixels that are disposed at intersections of the scan lines and the signal lines and arranged in a matrix, each of the pixels having at least a sampling transistor, a drive transistor, a switching transistor, a hold capacitor, and a light-emitting element; and a drive part configured to include a scanner and a driver, the driver supplying a video signal to the signal lines along the columns, wherein a control terminal of the sampling transistor is connected to the scan line, and a pair of current terminals of the sampling transistor are connected between the signal line and a control terminal of the drive transistor, a current terminal of the drive transistor on a drain side is connected to a power supply, and a current terminal of the drive transistor on a source side is connected to the light-emitting element, the hold capacitor is connected between the control terminal of the drive transistor as a gate of the drive transistor and the current terminal of the drive transistor on the source side, one of a pair of current terminals of the switching transistor is connected to the current terminal of the drive transistor on the source side and the other of the pair of current terminals of the switching transistor is coupled to a fixed potential, and a control terminal of the switching transistor is connected to the scan line disposed on a row previous to a row of the scan line connected to the control terminal of the sampling transistor, the scanner drives the sampling transistor and the switching transistor included in the pixel by sequentially supplying a control signal to the scan lines along the rows, to supply a drive current dependent upon a video signal from the drive transistor to the light-emitting element, wherein the scanner carries out a correction operation of writing a threshold voltage of the drive transistor to the hold capacitor repeatedly in a time-division manner by driving the sampling transistor and the switching transistor, the driver supplies, to the signal lines, a video signal whose potential is switched among a reference potential, a lower potential lower than the reference potential, and a signal potential higher than the reference potential, the reference potential is applied to the control terminal of the drive transistor in correction operation, the lower potential is applied to the control terminal of the drive transistor after immediately preceding correction operation and before start of next correction operation, and the signal potential is applied to the control terminal of the drive transistor after completion of last correction operation.

2. The display device according to claim 1, wherein an anode of the light-emitting element is connected to the current terminal of the drive transistor on the source side, and a cathode of the light-emitting element is coupled to a predetermined cathode potential, and the fixed potential coupled to the current terminal of the switching transistor is lower than the cathode potential.

3. The display device according to claim 1, wherein the switching transistor is turned on at a preparatory stage previous to the correction operation to apply the fixed potential to the current terminal of the drive transistor on the source side.

4. An electronic apparatus comprising:

a display device including a pixel array part configured to include scan lines disposed along rows, signal lines disposed along columns, and pixels that are disposed at intersections of the scan lines and the signal lines and arranged in a matrix, each of the pixels having at least a sampling transistor, a drive transistor, a switching transistor, a hold capacitor, and a light-emitting element; and a drive part configured to include a scanner and a driver, the driver supplying a video signal to the signal lines along the columns, wherein a control terminal of the sampling transistor is connected to the scan line, and a pair of current terminals of the sampling transistor are connected between the signal line and a control terminal of the drive transistor, a current terminal of the drive transistor on a drain side is connected to a power supply, and a current terminal of the drive transistor on a source side is connected to the light-emitting element, the hold capacitor is connected between the control terminal of the drive transistor as a gate of the drive transistor and the current terminal of the drive transistor on the source side, one of a pair of current terminals of the switching transistor is connected to the current terminal of the drive transistor on the source side and the other of the pair of current terminals of the switching transistor is coupled to a fixed potential, and a control terminal of the switching transistor is connected to the scan line disposed on a row previous to a row of the scan line connected to the control terminal of the sampling transistor, the scanner drives the sampling transistor and the switching transistor included in the pixel by sequentially supplying a control signal to the scan lines along the rows, to supply a drive current dependent upon a video signal from the drive transistor to the light-emitting element, wherein the scanner carries out a correction operation of writing a threshold voltage of the drive transistor to the hold capacitor repeatedly in a time-division manner by driving the sampling transistor and the switching transistor, the driver supplies, to the signal lines, a video signal whose potential is switched among a reference potential, a lower potential lower than the reference potential, and a signal potential higher than the reference potential, the reference potential is applied to the control terminal of the drive transistor in correction operation, the lower potential is applied to the control terminal of the drive transistor after immediately preceding correction operation and before start of next correction operation, and the signal potential is applied to the control terminal of the drive transistor after completion of last correction operation.

5. A display device comprising:

pixel arraying means for including scan lines disposed along rows, signal lines disposed along columns, and pixels that are disposed at intersections of the scan lines and the signal lines and arranged in a matrix, each of the pixels having at least a sampling transistor, a drive transistor, a switching transistor, a hold capacitor, and a light-emitting element; and driving means for including a scanner and a driver, the driver supplying a video signal to the signal lines along the columns, wherein a control terminal of the sampling transistor is connected to the scan line, and a pair of current terminals of the sampling transistor are connected between the signal line and a control terminal of the drive transistor, a current terminal of the drive transistor on a drain side is connected to a power supply, and a current terminal of the drive transistor on a source side is connected to the light-emitting element, the hold capacitor is connected between the control terminal of the drive transistor as a gate of the drive transistor and the current terminal of the drive transistor on the source side, one of a pair of current terminals of the switching transistor is connected to the current terminal of the drive transistor on the source side and the other of the pair of current terminals of the switching transistor is coupled to a fixed potential, and a control terminal of the switching transistor is connected to the scan line disposed on a row previous to a row of the scan line connected to the control terminal of the sampling transistor, and the scanner drives the sampling transistor and the switching transistor included in the pixel by sequentially supplying a control signal to the scan lines along the rows, to supply a drive current dependent upon a video signal from the drive transistor to the light-emitting element, wherein the scanner carries out a correction operation of writing a threshold voltage of the drive transistor to the hold capacitor repeatedly in a time-division manner by driving the sampling transistor and the switching transistor, the driver supplies, to the signal lines, a video signal whose potential is switched among a reference potential, a lower potential lower than the reference potential, and a signal potential higher than the reference potential, the reference potential is applied to the control terminal of the drive transistor in correction operation, the lower potential is applied to the control terminal of the drive transistor after immediately preceding correction operation and before start of next correction operation, and the signal potential is applied to the control terminal of the drive transistor after completion of last correction operation.

* * * * *